US009776433B2

(12) United States Patent
Nishimura

(10) Patent No.: US 9,776,433 B2
(45) Date of Patent: Oct. 3, 2017

(54) CONVEYOR AND IMAGE RECORDING APPARATUS

(71) Applicant: BROTHER KOGYO KABUSHIKI KAISHA, Nagoya-shi, Aichi-ken (JP)

(72) Inventor: Yoichiro Nishimura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/277,438

(22) Filed: Sep. 27, 2016

(65) Prior Publication Data

US 2017/0087877 A1 Mar. 30, 2017

(30) Foreign Application Priority Data

Sep. 30, 2015 (JP) ..... 2015-194525

(51) Int. Cl.

| | |
|---|---|
| ***B41J 17/02*** | (2006.01) |
| ***B41J 11/00*** | (2006.01) |
| ***B41J 2/01*** | (2006.01) |
| ***B41J 13/00*** | (2006.01) |
| ***B65H 5/06*** | (2006.01) |
| *B41J 3/60* | (2006.01) |

(52) U.S. Cl.

CPC ..... *B41J 11/007* (2013.01); *B41J 2/01* (2013.01); *B41J 13/009* (2013.01); *B41J 17/02* (2013.01); *B65H 5/062* (2013.01); *B41J 3/60* (2013.01)

(58) Field of Classification Search

CPC ..... B41J 11/007; B41J 17/02; B41J 13/009; B41J 2/01; B41J 3/60; B65H 5/062

See application file for complete search history.

(56) References Cited

U.S. PATENT DOCUMENTS

2002/0118395 A1* 8/2002 Isozaki ..... H04N 1/0461 358/400
2013/0256976 A1 10/2013 Samoto et al.
2015/0273906 A1* 10/2015 Samoto ..... B41J 23/025 347/104

FOREIGN PATENT DOCUMENTS

JP 2013-203503 A 10/2013

* cited by examiner

*Primary Examiner* — Manish S Shah
*Assistant Examiner* — Yaovi M Ameh
(74) *Attorney, Agent, or Firm* — Merchant & Gould P.C.

(57) ABSTRACT

A conveyor includes: a first power transmitting mechanism configured to transmit one of forward rotation and reverse rotation of a motor to a first roller and not to transmit the other from a driven member to the first roller; and a second power transmitting mechanism configured to transmit the other rotation to the first roller and not to transmit the one rotation to the first roller. The first power transmitting mechanism includes a transmission delayer that does not transmit rotation of the motor from the driven member to the first roller until the motor is rotated by a particular amount from a time point at which the motor starts to be rotated in a rotational direction of the one rotation when rotation transmitted from the motor to the driven member is changed from the other rotation to the one rotation.

13 Claims, 10 Drawing Sheets

CONVEYOR AND IMAGE RECORDING APPARATUS

CROSS REFERENCE TO RELATED APPLICATION

The present application claims priority from Japanese Patent Application No. 2015-194525, which was filed on Sep. 30, 2015, the disclosure of which is herein incorporated by reference in its entirety.

BACKGROUND

Technical Field

The following disclosure relates to a conveyor configured to convey a sheet along a conveyance path and to an image recording apparatus including the conveyor and configured to perform image recording on the sheet.

Description of the Related Art

There is known a conveyor configured to convey a sheet along a conveyance path. An image recording apparatus for performing image recording on a sheet is one example of an apparatus including the conveyor. The image recording apparatus includes a plurality of driven members which are driven by a motor. Examples of the driven members include rollers. The rollers are rotated to convey the sheet.

To reduce the size and cost of the image recording apparatus, a smaller number of motors are preferably provided in the image recording apparatus. That is, the driven members provided in the image recording apparatus are preferably driven by the same motor. Also, recently expanding functionality of the image recording apparatus increases a demand of a construction in which in the case where some of the driven members are driven, the other driven members are driven or stopped. For example, there is a demand of a construction in which in the case where some of a plurality of rollers are rotated forwardly, the other rollers are rotated reversely, and a construction in which in the case where some of the rollers are rotated, the other rollers are stopped.

One example of such an image recording apparatus includes: an output roller for conveying a sheet to an output tray after image recording on the sheet by a recorder; and a conveying roller for conveying the sheet to the recorder. The image recording apparatus includes: first and second power transmitters for transmitting power produced by a motor from the conveying roller to the output roller; and a switcher that selectively allows or disallows the power transmission from the motor to the second power transmitter. The first power transmitter includes the one-way clutch and thereby transmits only forward rotation of the motor from the conveying roller to the output roller. The second power transmitter includes: a planetary gear mechanism constituted by a sun gear and a planetary gear; and a transmission gear and thereby transmits only reverse rotation of the motor from the conveying roller to the output roller. That is, upon the reverse rotation of the conveying roller, the planetary gear is engaged with the transmission gear in the second power transmitter, and upon the forward rotation of the conveying roller, the planetary gear is moved off and away from the transmission gear in the second power transmitter. In the image recording apparatus constructed as described above, the first power transmitter and the second power transmitter can transmit the forward rotation and the reverse rotation of the motor from the conveying roller to the output roller, while the switcher can interrupt the power transmission from the motor to the second power transmitter to stop the output roller while rotating the conveying roller.

SUMMARY

However, the image recording apparatus described above may suffer from the following problems. In a state in which the reverse rotation of the motor is transmittable from the conveying roller to the output roller by the second power transmitter, when the rotation of the motor is switched from the reverse rotation to the forward rotation, the planetary gear is moved off the transmission gear, and thereby the power transmission to the output roller via the second power transmitter is interrupted, and the power transmission to the output roller via the first power transmitter is allowed. In this state, the forward rotation of the motor is transmittable to the transmission gear of the second power transmitter via the first power transmitter and the output roller though the transmission gear normally transmits the reverse rotation of the motor to the output roller.

In the case where the timing of the power transmission to the output roller via the first power transmitter is earlier than the timing at which the planetary gear is moved off the transmission gear when the rotation of the motor is switched from the reverse rotation to the forward rotation, the transmission gear is to be rotated by the forward rotation of the motor transmitted via the first power transmitter and the output roller in the state in which the transmission gear is engaged with the planetary gear. As a result, the planetary gear cannot be moved off the transmission gear, resulting in increase in load on the motor, whereby the motor is locked and cannot be rotated.

Accordingly, an aspect of the disclosure relates to a conveyor capable of preventing establishment of a lock state of a motor for applying rotation to a roller, and to an image recording apparatus including the conveyor.

In one aspect of the disclosure, a conveyor includes: a motor that is rotated forwardly and reversely; a driven member that is driven by rotation caused by at least one of forward rotation and reverse rotation of the motor, the caused rotation being transmitted from the motor; a first roller provided on a first conveyance path through which a sheet is to be conveyed; a first power transmitting mechanism configured to transmit rotation caused by one of the forward rotation and the reverse rotation of the motor to the first roller and not to transmit rotation caused by the other of the forward rotation and the reverse rotation of the motor from the driven member to the first roller; and a second power transmitting mechanism configured to transmit the rotation caused by the other of the forward rotation and the reverse rotation of the motor to the first roller and not to transmit the rotation caused by the one of the forward rotation and the reverse rotation of the motor to the first roller. The second power transmitting mechanism includes: a sun gear that is rotated in a first rotational direction by receiving the rotation caused by the one of the forward rotation and the reverse rotation of the motor from the driven member and that is rotated in a second rotational direction by receiving the rotation caused by the other of the forward rotation and the reverse rotation of the motor from the driven member, the second rotational direction being reverse to the first rotational direction; an arm pivotably supported by the sun gear; a planetary gear rotatably supported by the arm in a state in which the planetary gear is engaged with the sun gear, the planetary gear being configured to be revolved around the sun gear; and a transmission gear engageable with the planetary gear and configured to transmit, to the first roller, rotation of the motor which is transmitted from the planetary gear. The planetary gear is configured to be revolved, in a direction in which the planetary gear is moved away from the transmission gear, by rotation of the sun gear in the first rotational direction, the planetary gear being configured to be revolved, in a direction in which the planetary gear is to be engaged with the transmission gear, by rotation of the sun gear in the second rotational direction. The first power transmitting mechanism includes a transmission delayer that does not transmit the rotation of the motor from the driven member to the first roller until the motor is rotated by a particular amount from a time point at which the motor starts to be rotated in a rotational direction of the one of the forward rotation and the reverse rotation when rotation transmitted from the motor to the driven member is changed from the other of the forward rotation and the reverse rotation to the one of the forward rotation and the reverse rotation.

In another aspect of the disclosure, an image recording apparatus includes: a conveyor including (i) a motor that is rotated forwardly and reversely, (ii) a driven member that is driven by rotation caused by at least one of forward rotation and reverse rotation of the motor, the caused rotation being transmitted from the motor, (iii) a first roller provided on a first conveyance path through which a sheet is to be conveyed, (iv) a first power transmitting mechanism configured to transmit rotation caused by one of the forward rotation and the reverse rotation of the motor to the first roller and not to transmit rotation caused by the other of the forward rotation and the reverse rotation of the motor from the driven member to the first roller, and (v) a second power transmitting mechanism configured to transmit the rotation caused by the other of the forward rotation and the reverse rotation of the motor to the first roller and not to transmit the rotation caused by the one of the forward rotation and the reverse rotation of the motor to the first roller; and an image recorder provided on the first conveyance path and configured to record an image on the sheet. The second power transmitting mechanism includes: a sun gear that is rotated in a first rotational direction by receiving the rotation caused by the one of the forward rotation and the reverse rotation of the motor from the driven member and that is rotated in a second rotational direction by receiving the rotation caused by the other of the forward rotation and the reverse rotation of the motor from the driven member, the second rotational direction being reverse to the first rotational direction; an arm pivotably supported by the sun gear; a planetary gear rotatably supported by the arm in a state in which the planetary gear is engaged with the sun gear, the planetary gear being configured to be revolved around the sun gear; and a transmission gear engageable with the planetary gear and configured to transmit, to the first roller, rotation of the motor which is transmitted from the planetary gear. The planetary gear is configured to be revolved, in a direction in which the planetary gear is moved away from the transmission gear, by rotation of the sun gear in the first rotational direction, the planetary gear being configured to be revolved, in a direction in which the planetary gear is to be engaged with the transmission gear, by rotation of the sun gear in the second rotational direction. The first power transmitting mechanism includes a transmission delayer that does not transmit the rotation of the motor from the driven member to the first roller until the motor is rotated by a particular amount from a time point at which the motor starts to be rotated in a rotational direction of the one of the forward rotation and the reverse rotation when rotation transmitted from the motor to the driven member is changed from the other of the forward rotation and the reverse rotation to the one of the forward rotation and the reverse rotation.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
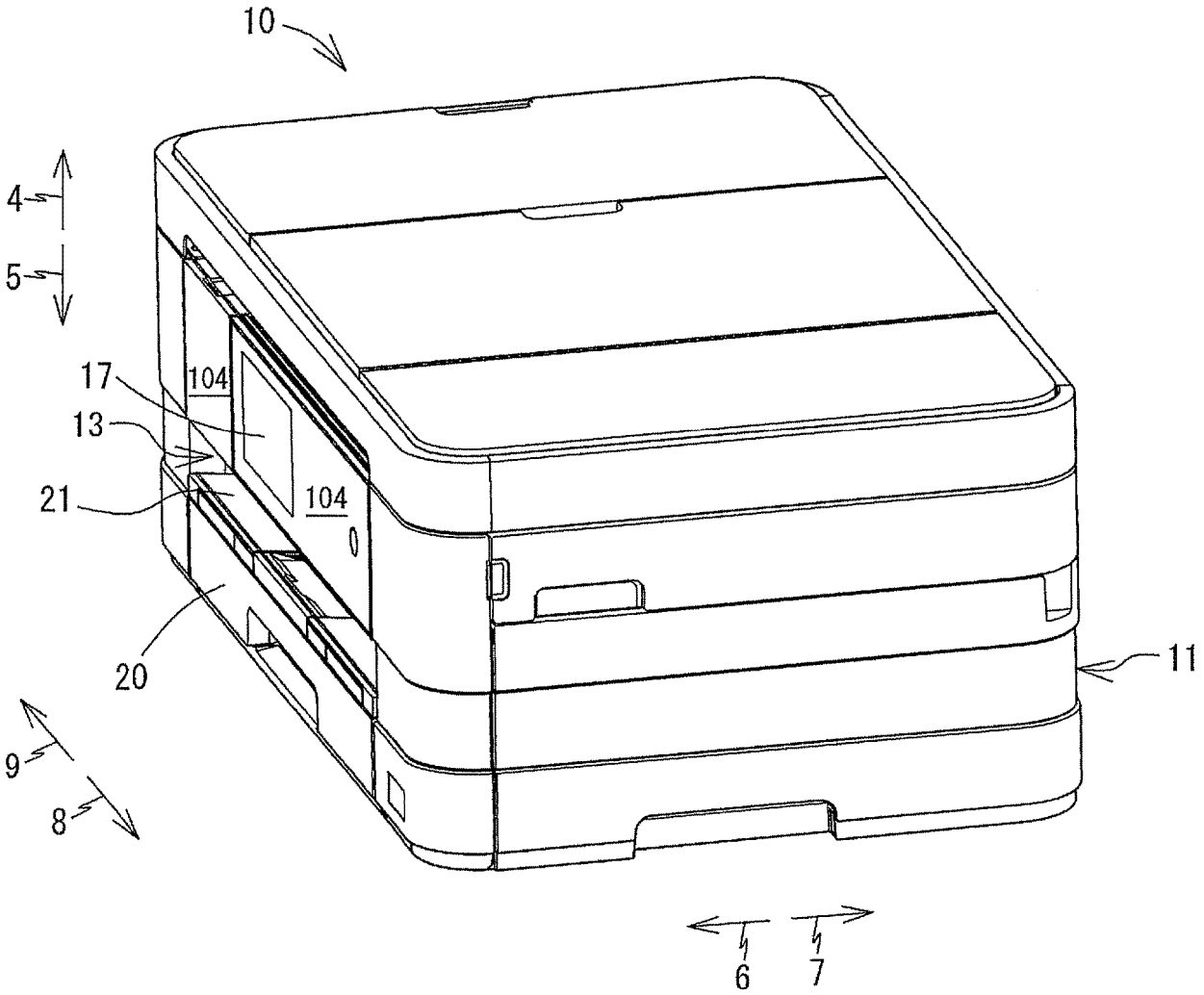
FIG. 1 is a perspective view of a multi-function peripheral (MFP)

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the following explanation, up and down directions 4, 5 are defined in this state. Also, front and rear directions 6, 7 are defined by regarding a side of the MFP 10 on which an opening 13 is formed as a front side (a front surface 104), and right and left directions 8, 9 are defined in a state in which the MFP 10 is viewed from the front. The up direction 4 and the down direction 5 are opposite each other. The front direction 6 and the rear direction 7 are opposite each other. The right direction 8 and the left direction 9 are opposite each other. The up direction 4, the front direction 6, and the right direction 8 are perpendicular to one another.

Overall Construction of MFP 10

As illustrated in FIG. 1, the MFP 10 as one example of an image recording apparatus has a generally rectangular parallelepiped shape. The MFP 10 includes a printer 11 at its lower portion. The printer 11 is an ink-jet printer configured to record an image or images on a sheet 12 (see FIG. 2). The MFP 10 has various functions including a facsimile function and a printing function. It is noted that the printer 11 may employ various recording techniques other than the ink-jet technique, for example, the printer 11 may use electronic photography to record an image or images on the sheet 12.

Figure 2:
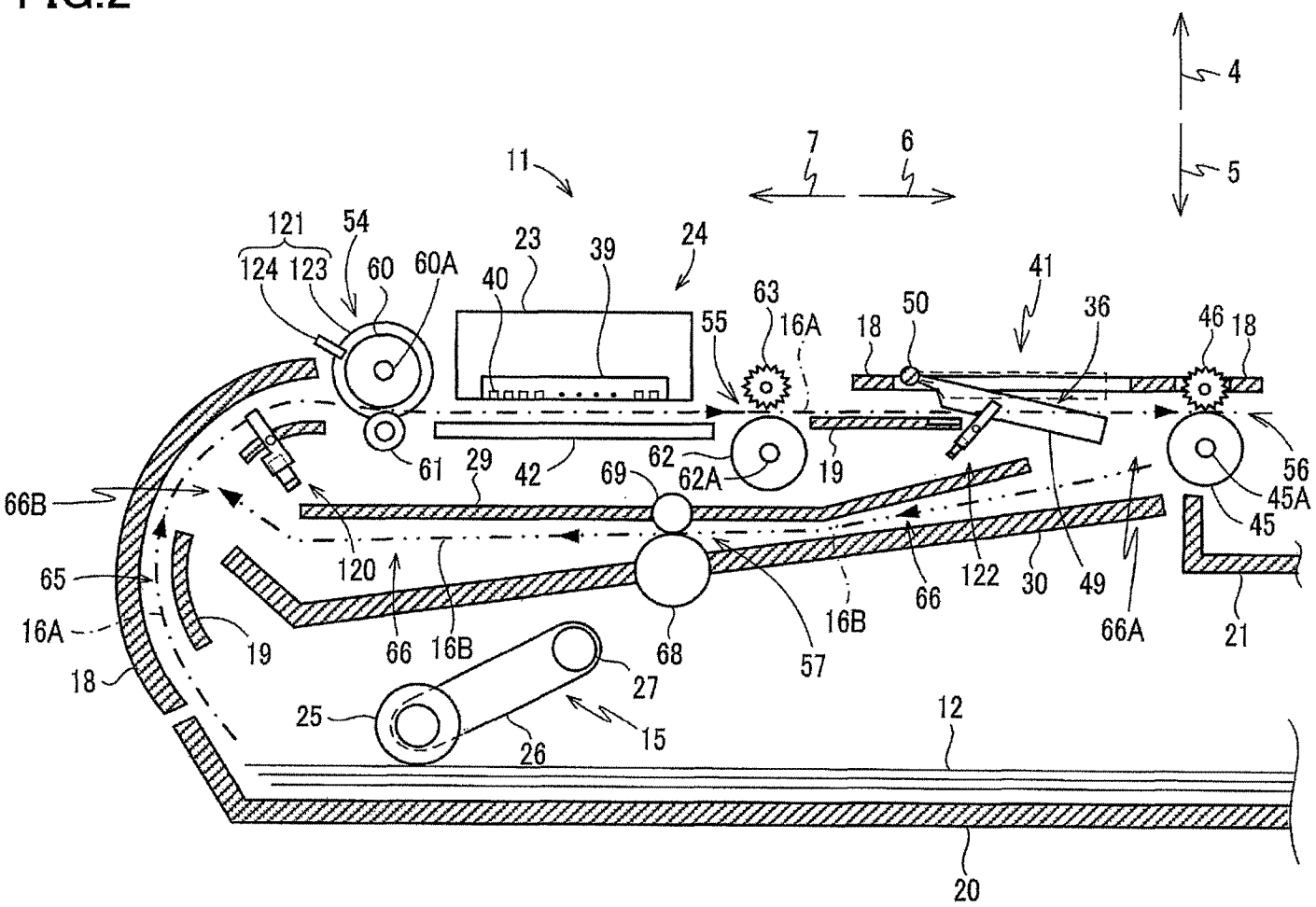
FIG. 2 is an elevational view in vertical cross section schematically illustrating an internal structure of a printer.

As illustrated in FIG. 2, the printer 11 includes a conveyor, an image recorder 24, and a platen 42. The conveyor includes a supplier 15, a supply tray 20 as one example of a tray, an output tray 21, a conveying unit 54, a sheet discharger 55, a reversing device 56, a re-conveying unit 57, a conveying motor 102 as one example of a motor (see FIG. 7), and a drive-power transmitting mechanism 70 (see FIG. 7).

Supply Tray 20 and Output Tray 21

As illustrated in FIGS. 1 and 2, the supply tray 20 is inserted into the printer 11 in the rear direction 7 and removed in the front direction 6 through the opening 13 formed in a front portion of the printer 11. The supply tray 20 supports the sheets 12 stacked on one another. The output tray 21 is disposed on the supply tray 20. The output tray 21 supports the sheets 12 discharged by the reversing device 56 through the opening 13.

Supplier 15

As illustrated in FIG. 2, the supplier 15 includes a supply roller 25, a supply arm 26, and a shaft 27. The supply roller 25 is rotatably supported at a distal end portion of the supply arm 26. Reverse rotation of the conveying motor 102 (see FIG. 7) rotates the supply roller 25 in a direction in which the sheet 12 supported on the supply tray 20 is conveyed in a first conveying direction 16A as one example of a conveying direction. The first conveying direction 16A is a direction along a first conveyance path 65 which will be described below and indicated by the one-dot-chain-line arrows in FIG. 2. The sheet 12 supplied by the supply roller 25 in the first conveying direction 16A travels toward the conveying unit 54 disposed on the first conveyance path 65. The supply arm 26 is pivotably supported by the shaft 27 that is supported by a frame of the printer 11.

In the following explanation, rotation of the supply roller 25 in the direction in which the sheet 12 is conveyed in the first conveying direction 16A may be hereinafter referred to as "forward rotation".

First Conveyance Path 65 and Second Conveyance Path 66

As illustrated in FIG. 2, the printer 11 has the first conveyance path 65 and a second conveyance path 66 through which the sheet 12 is conveyed. The first conveyance path 65 is a space defined in the printer 11 by guide members 18, 19 that are opposed to each other with a predetermined distance therebetween.

The first conveyance path 65 includes a curved conveyance path and a straight conveyance path. The curved conveyance path makes an upward U-turn in a rear portion of the printer 11. The straight conveyance path extends from the conveying unit 54 to the output tray 21 via the image recorder 24. In the present embodiment, the sheet discharger 55 and the reversing device 56 are arranged on the straight conveyance path of the first conveyance path 65.

It is noted that the first conveyance path 65 is constituted by the curved conveyance path and the straight conveyance path in FIG. 2 in the present embodiment but may be constituted by only the straight conveyance path, for example.

The second conveyance path 66 is a space defined in the printer 11 by guide members 29, 30 that are opposed to each other with a predetermined distance therebetween. After image recording performed by the image recorder 24, the sheet 12 is conveyed in the second conveyance path 66 in which the sheet 12 is turned upside down and conveyed toward the image recorder 24 for back-side recording. In the present embodiment, the second conveyance path 66 is branched off from the first conveyance path 65 at a branch position 66A (as one example of a first connecting position) and merged with the first conveyance path 65 at a merge position 66B (as one example of a second connecting position). The branch position 66A is located downstream of the image recorder 24 in the first conveying direction 16A. The merge position 66B is located upstream of a first sensor 120, which will be described below, in the first conveying direction 16A. A second conveying direction 16B in which the sheet 12 is to be conveyed in the second conveyance path 66 is indicated by the two-dot-chain-line arrows in FIG. 2.

Conveying Unit 54, Sheet Discharger 55, Reversing Device 56, and Re-Conveying Unit 57

As illustrated in FIG. 2, the conveying unit 54 is disposed on the first conveyance path 65 at a position located between the first sensor 120 and the image recorder 24. The conveying unit 54 includes a conveying roller 60 and a pinch roller 61 opposed to each other. The conveying roller 60 is one example of a driven member and a second roller. The conveying roller 60 is driven by the conveying motor 102. The pinch roller 61 is rotated by rotation of the conveying roller 60.

The sheet discharger 55 is disposed on the first conveyance path 65 at a position located between the image recorder 24 and the branch position 66A. The sheet discharger 55 includes an output roller 62 and a spur 63 opposed to each other. The output roller 62 is one example of a first roller. The output roller 62 is driven by the conveying motor 102. The spur 63 is rotated by rotation of the output roller 62.

The reversing device 56 is disposed on the first conveyance path 65 at a position located downstream of the branch position 66A in the first conveying direction 16A. The reversing device 56 includes a reversible roller 45 and a spur 46 opposed to each other. The reversible roller 45 is one example of a fourth roller. The reversible roller 45 is driven by the conveying motor 102. The spur 46 is rotated by rotation of the reversible roller 45.

As will be described below, each of the conveying roller 60, the output roller 62, and the reversible roller 45 is rotatable in (i) a direction in which the sheet 12 is to be conveyed in the first conveying direction 16A and (ii) a direction reverse to this direction. In the following explanation, rotation of each of the rollers 60, 62, 45 in the direction for conveying the sheet 12 in the first conveying direction 16A may be hereinafter referred to as "forward rotation". Rotation of each of the rollers 60, 62, 45 in the direction reverse to the direction of the forward rotation may be hereinafter referred to as "reverse rotation".

The re-conveying unit 57 is disposed on the second conveyance path 66. The re-conveying unit 57 includes a re-conveying roller 68 and a driven roller 69 opposed to each other. The re-conveying roller 68 is one example of a third roller. The re-conveying roller 68 is driven by the conveying motor 102. The driven roller 69 is rotated by rotation of the re-conveying roller 68.

As will be described below, the re-conveying roller 68 is rotatable in such a direction that the sheet 12 is to be conveyed in the second conveying direction 16B. In the following explanation, rotation of the re-conveying roller 68 in such a direction that the sheet 12 is to be conveyed in the second conveying direction 16B may be hereinafter referred to as "forward rotation".

Image Recorder 24

As illustrated in FIG. 2, the image recorder 24 is disposed on the straight conveyance path of the first conveyance path 65. In the present embodiment, the image recorder 24 is disposed on the first conveyance path 65 at a position located between the conveying unit 54 and the sheet discharger 55.

The image recorder 24 is disposed over and opposed to the platen 42. An upper surface of the platen 42 supports the sheet 12 conveyed by the conveying unit 54. The image recorder 24 includes a carriage 23 and a recording head 39.

Figure 3:
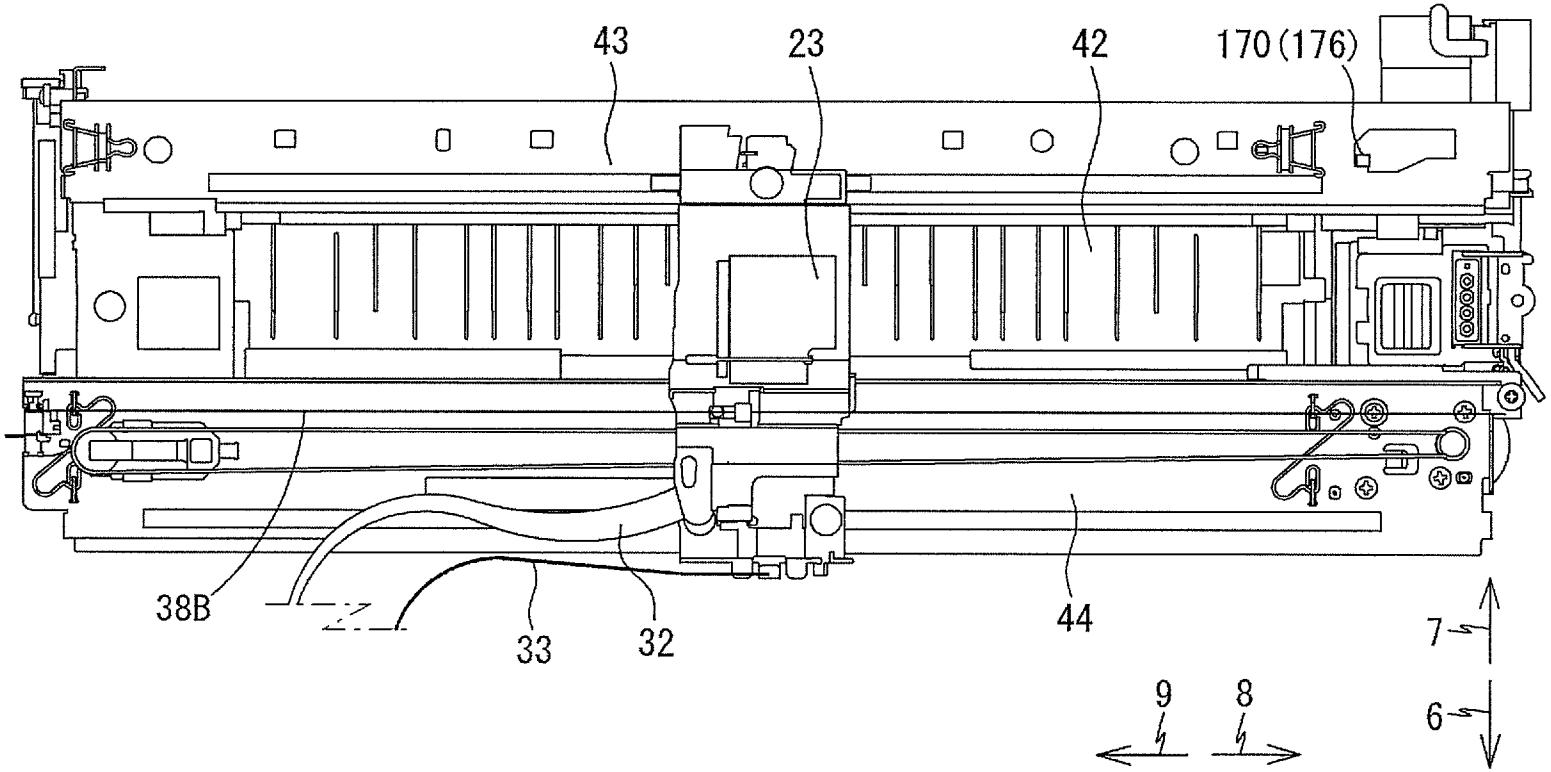
FIG. 3 is a plan view of a carriage and guide rails.

As illustrated in FIG. 3, an ink tube 32 and a flexible flat cable 33 extend from the carriage 23. The ink is supplied from an ink cartridge to the recording head 39 through the ink tube 32. The flexible flat cable 33 is electrically connected between the recording head 39 and a control board on which a controller 130 (see FIG. 8) is mounted.

The carriage 23 is supported by guide rails 43, 44. The guide rails 43, 44 are spaced apart from each other in the front and rear directions 6, 7. The guide rails 43, 44 extend in the right and left directions 8, 9. The carriage 23 is coupled to a well-known belt mechanism provided on the guide rail 44. The belt mechanism is rotated by a carriage motor 103 (see FIG. 8). This rotation of the belt mechanism reciprocates the carriage 23 in the right and left directions 8, 9.

As illustrated in FIG. 2, the recording head 39 is mounted on the carriage 23. A lower surface of the recording head 39 has a multiplicity of nozzles 40. The recording head 39 ejects fine ink droplets from the nozzles 40. During movement of the carriage 23, the recording head 39 ejects the ink droplets onto the sheet 12 supported on the platen 42. As a result, an image is recorded on the sheet 12.

Path Switcher 41

As illustrated in FIG. 2, the printer 11 includes a path switcher 41 disposed on the first conveyance path 65 at a position located between the sheet discharger 55 and the reversing device 56. The path switcher 41 includes a flap 49 and the shaft 50. The flap 49 extends from the shaft 50 generally in the first conveying direction 16A. The flap 49 is pivotably supported by the shaft 50. The flap 49 pivots about the shaft 50 between a flip position (indicated by the solid lines in FIG. 2) at which the flap 49 closes the first conveyance path 65 and a discharge position (indicated by the broken lines in FIG. 2) at which the flap 49 allows passage of the sheet 12 on the first conveyance path 65. It is noted that the flap 49 may be moved between the flip position and the discharge position by operations other than the pivotal movement of the flap 49. For example, the flap 49 may be moved between the flip position and the discharge position by movement of the flap 49 in the up and down directions 4, 5, for example.

In a normal state, the flap 49 is located at the flip position by its own weight. The flap 49 may be urged to the flip position by a spring, for example. The sheet 12 conveyed in the first conveying direction 16A causes upward pivotal movement of the flap 49 about the shaft 50 from the flip position to the discharge position. In this state, the flap 49 guides the sheet 12 conveyed in the first conveying direction 16A. When a trailing end of the sheet 12 (i.e., an upstream end of the sheet 12 in the first conveying direction 16A) conveyed in the first conveying direction 16A has reached the branch position 66A, the flap 49 is moved from the discharge position to the flip position by its own weight.

When the reversible roller 45 of the reversing device 56 is kept rotated forwardly in this state, the sheet 12 is conveyed in the first conveying direction 16A and discharged onto the output tray 21 as will be described below. When the rotation of the reversible roller 45 of the reversing device 56 is switched from the forward rotation to the reverse rotation, the sheet 12 is conveyed along the second conveyance path 66 in the second conveying direction 16B in a state in which the upstream end of the sheet 12 in the first conveying direction 16A serves as a leading end as will be described below.

First Sensor 120 and Second Sensor 122

As illustrated in FIG. 2, the printer 11 includes the well-known first sensor 120 disposed on the first conveyance path 65 at a position located between the merge position 66B and the conveying unit 54. The first sensor 120 detects the presence of the sheet 12 at a position at which the first sensor 120 is disposed. The sheet 12 conveyed by the supplier 15 or the re-conveying unit 57 is conveyed to the conveying unit 54 after passing through the position at which the first sensor 120 is disposed. When the sheet 12 is present at the position at which the first sensor 120 is disposed, the first sensor 120 outputs one of a high-level signal and a low-level signal (the low-level signal in the present embodiment) to the controller 130 (see FIG. 8). When the sheet 12 is absent at the position at which the first sensor 120 is disposed, the first sensor 120 outputs the other of the high-level signal and the low-level signal (the high-level signal in the present embodiment) to the controller 130.

The printer 11 includes a second sensor 122 disposed at the branch position 66A. Like the first sensor 120, when the sheet 12 is present at a position at which the second sensor 122 is disposed, the second sensor 122 outputs one of a high-level signal and a low-level signal (the low-level signal in the present embodiment) to the controller 130. When the sheet 12 is absent at the position at which the second sensor 122 is disposed, the second sensor 122 outputs the other of the high-level signal and the low-level signal (the high-level signal in the present embodiment) to the controller 130.

Rotary Encoder 121

As illustrated in FIG. 2, the printer 11 includes a well-known rotary encoder 121 which produces a pulse signal in accordance with the rotation of the conveying roller 60. The rotary encoder 121 includes an encoder disc 123 and an optical sensor 124. The encoder disc 123 is rotated with the rotation of the conveying roller 60. The optical sensor 124 reads the encoder disc 123 being rotated, produces the pulse signal, and outputs the produced pulse signal to the controller 130.

Drive-Power Transmitting Mechanism 70

Figure 8:
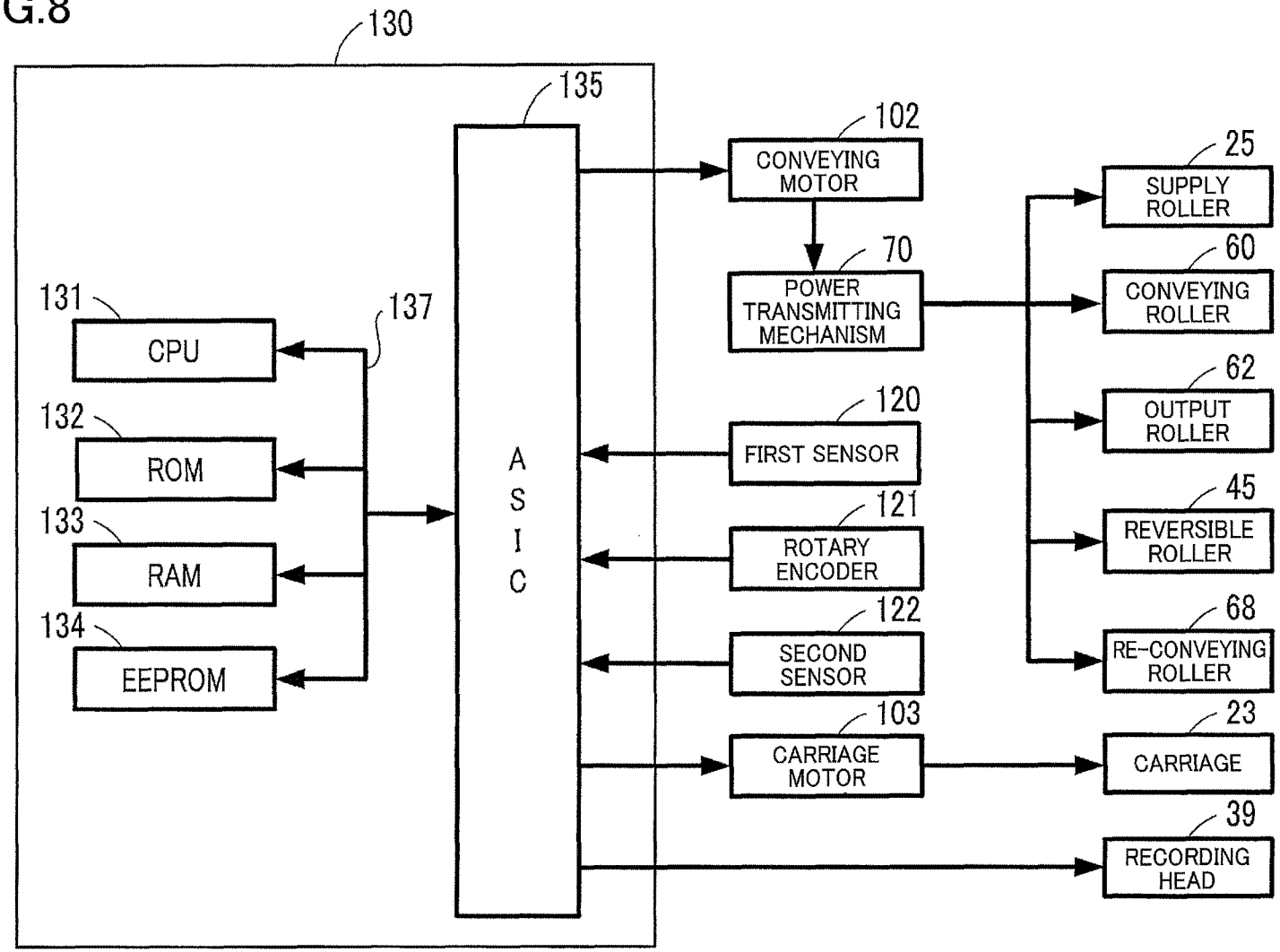
FIG. 8 is a block diagram illustrating the printer.

As illustrated in FIG. 8, the drive-power transmitting mechanism 70 transmits rotation of the single conveying motor 102 (i.e., power generated by the rotation of the conveying motor 102) to the supply roller 25, the conveying roller 60, the output roller 62, the reversible roller 45, and the re-conveying roller 68. The drive-power transmitting mechanism 70 is constituted by combination of all or some of gears, pulleys, endless belts, planetary gear mechanisms, one-way clutches, and other similar components.

As illustrated in FIGS. 5A-7, the drive-power transmitting mechanism 70 includes: a pulley 71 that is rotated together with a shaft of the conveying motor 102; a pulley 72 that is rotated together with a shaft 60A of the conveying roller 60; and an endless belt 73 looped over the pulleys 71, 72. When the forward rotation of the conveying motor 102 is transmitted to the conveying roller 60, the conveying roller 60 is rotated forwardly. When the reverse rotation of the conveying motor 102 is transmitted to the conveying roller 60, the conveying roller 60 is rotated reversely. The forward rotation of the conveying roller 60 conveys the sheet 12 in the first conveying direction 16A, with the sheet 12 being nipped between the conveying roller 60 and the pinch roller 61.

Figure 7:
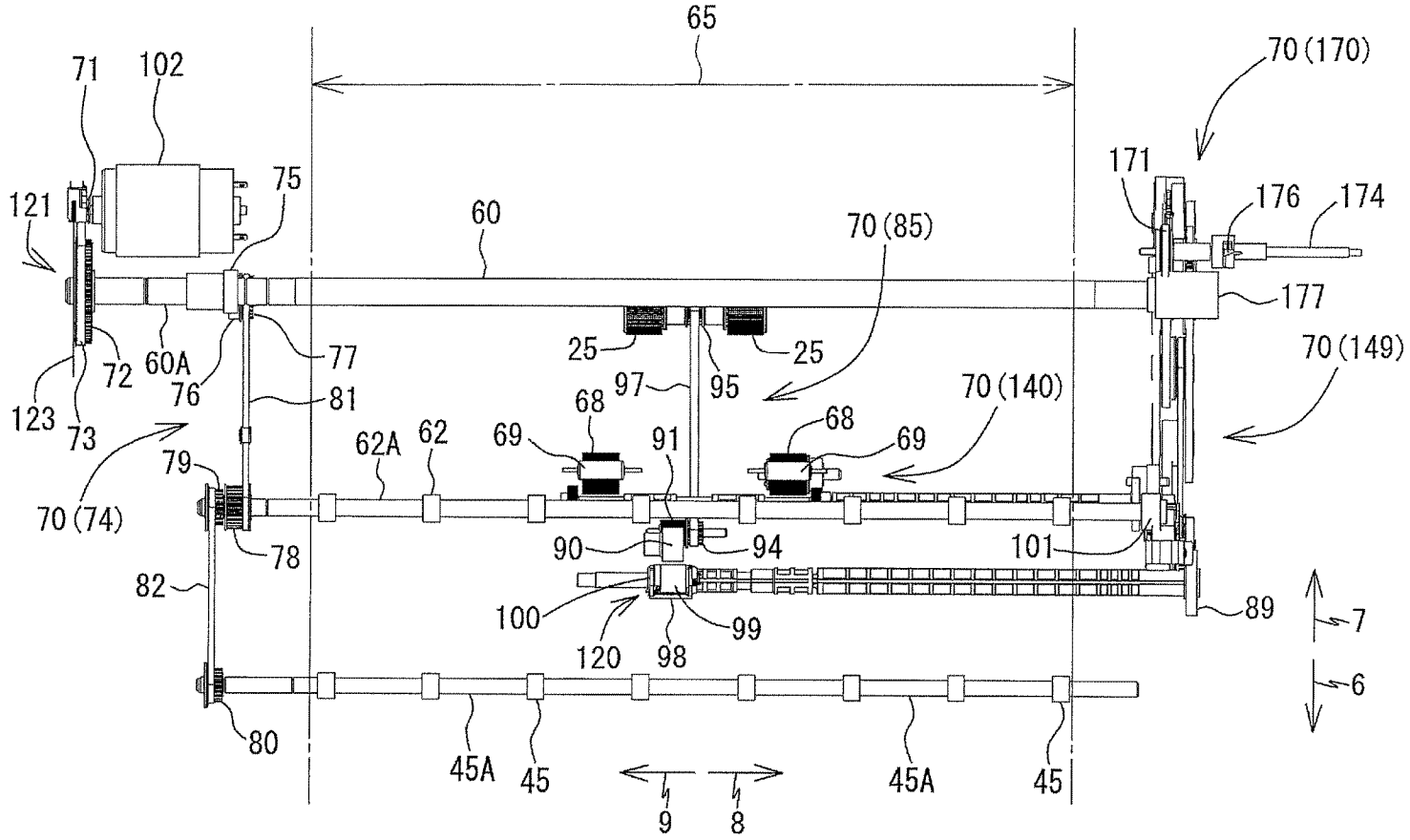
FIG. 7 is a plan view of a drive-power transmitting mechanism and rollers.

As illustrated in FIG. 7, the drive-power transmitting mechanism 70 includes: a switching mechanism 170 configured to switch a destination of transmission of the rotation of the conveying motor 102; and first to fourth transmitters 74, 149, 85, 140 configured to transmit the rotation of the conveying motor 102 to the rollers 25, 62, 45, 68 via the shaft 60A of the conveying roller 60. It is noted that a construction for transmitting the rotation of the conveying motor 102 to the rollers 25, 60, 62, 45, 68 is not limited to the construction described below. The first transmitter 74 is one example of a first drive-power transmitting mechanism. The second transmitter 149 is one example of a second drive-power transmitting mechanism. The third transmitter 85 is one example of a third drive-power transmitting mechanism. The fourth transmitter 140 is one example of a fourth drive-power transmitting mechanism.

Switching Mechanism 170

The switching mechanism 170 illustrated in FIGS. 4A-7 switches a state of transmission of the rotation of the conveying motor 102 between a first state and a second state.

In the first state, the rotation of the conveying motor 102 is allowed to be transmitted from the conveying roller 60 to the supply roller 25 via the third transmitter 85, the rotation of the conveying motor 102 is inhibited from being transmitted from the conveying roller 60 to the output roller 62 and the reversible roller 45 via the second transmitter 149, and the rotation of the conveying motor 102 is inhibited from being transmitted from the conveying roller 60 to the re-conveying roller 68 via the fourth transmitter 140.

In the second state, the rotation of the conveying motor 102 is inhibited from being transmitted from the conveying roller 60 to the supply roller 25 via the third transmitter 85, the rotation of the conveying motor 102 is allowed to be transmitted from the conveying roller 60 to the output roller 62 and the reversible roller 45 via the second transmitter 149, and the rotation of the conveying motor 102 is allowed to be transmitted from the conveying roller 60 to the re-conveying roller 68 via the fourth transmitter 140.

The switching mechanism 170 is provided to the right of the first conveyance path 65. The switching mechanism 170 includes a switching gear 171, a gear 177, two receiving gears 172A, 172B, a holder 173, a pushing member 175, a switching lever 176, a first spring, not illustrated, and a second spring, not illustrated.

The switching gear 171 is rotatable about a support shaft 174 and movable in the axial direction of the support shaft 174, i.e., in the right and left directions 8, 9. The rotation of the conveying motor 102 is transmitted to the switching gear 171 via the shaft 60A of the conveying roller 60 and the gear 177. The gear 177 is mounted on the shaft 60A of the conveying roller 60 and rotated together with the shaft 60A of the conveying roller 60. The receiving gears 172A, 172B are provided under the support shaft 174 so as to be rotatable about the same axis extending in the right and left directions 8, 9. Each of the receiving gears 172A, 172B is engageable with the switching gear 171. That is, the switching gear 171 is moved in the right and left directions 8, 9 and thereby engaged with any one of the receiving gears 172A, 172B.

The receiving gear 172A transmits the rotation of the conveying motor 102 to the supply roller 25 via the third transmitter 85. The receiving gear 172B transmits the rotation of the conveying motor 102 to the output roller 62 and the reversible roller 45 via the second transmitter 149 and to the re-conveying roller 68 via the fourth transmitter 140. When the switching gear 171 is in engagement with the receiving gear 172A, the switching mechanism 170 is in the first state. When the switching gear 171 is in engagement with the receiving gear 172B, the switching mechanism 170 is in the second state.

The pushing member 175 is disposed to the right of the switching gear 171. The support shaft 174 is inserted in the pushing member 175 such that the pushing member 175 is movable in the right and left directions 8, 9. The pushing member 175 is rotatable about the support shaft 174. The switching lever 176 protrudes upward from the pushing member 175 so as to extend through an opening 179 of the holder 173 to a portion of a moving path of the carriage 23, which portion is located outside a region through which the sheet 12 travels. The switching gear 171 is urged in the right direction 8 by the first spring, not illustrated, and the pushing member 175 is urged in the left direction 9 by the second spring, not illustrated. An urging force of the second spring is greater than that of the first spring. Thus, the switching gear 171 and the pushing member 175 are urged in the left direction 9 by the second spring.

The holder 173 is provided over the switching gear 171. The holder 173 has the opening 179. The switching lever 176 is inserted in the opening 179 in the up direction 4. An edge portion of the holder 173 which defines the opening 179 includes a first stopper 180, a second stopper 181 provided to the right of the first stopper 180, and an inclined surface 182 provided to the right of the second stopper 181.

Figure 4A:
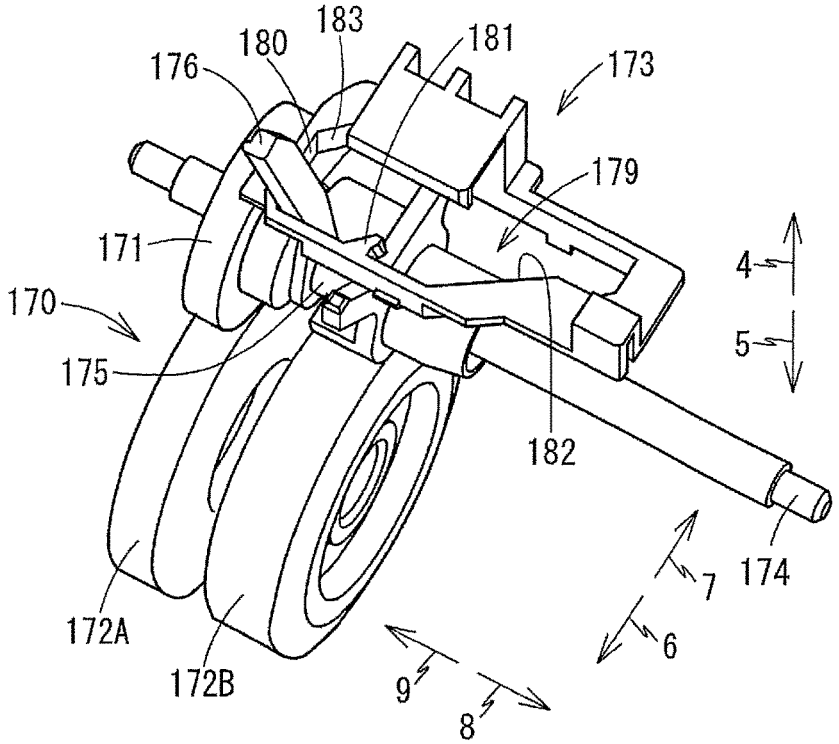
FIG. 4A is a perspective view of a switching mechanism in a first state.

As illustrated in FIG. 4A, the first stopper 180 is in contact with the switching lever 176 when the switching gear 171 is in engagement with the receiving gear 172A, that is, when the switching mechanism 170 is in the first state. This contact prevents the switching gear 171 from being moved leftward by the urging force of the second spring from a position of the switching gear 171 illustrated in FIG. 4A. The first stopper 180 does not prevent the switching gear 171 from moving rightward from the position of the switching gear 171 illustrated in FIG. 4A.

Figure 4B:
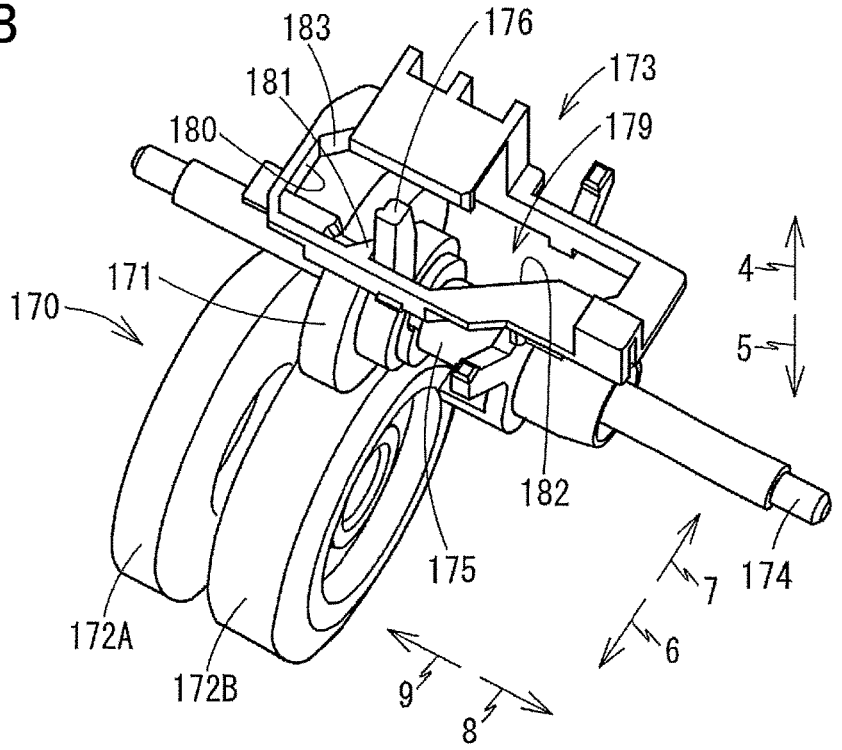
FIG. 4B is a perspective view of the switching mechanism in a second state.

As illustrated in FIG. 4B, the second stopper 181 is engaged with the switching lever 176 when the switching gear 171 is in engagement with the receiving gear 172B, that is, when the switching mechanism 170 is in the second state. This engagement of the second stopper 181 prevents the switching gear 171 from being moved leftward by the urging force of the second spring from a position illustrated in FIG. 4B. The second stopper 181 does not prevent the switching gear 171 from moving rightward from the position of the switching gear 171 illustrated in FIG. 4B.

As illustrated in FIG. 4A, the switching lever 176 is moved against the urging force of the second spring when the switching lever 176 is pushed by the carriage 23 moving rightward in the state in which the switching gear 171 is in engagement with the receiving gear 172A, that is, in the first state of the switching mechanism 170. As a result, the pushing member 175 is moved rightward with the switching lever 176. Since the switching gear 171 is urged in the right direction 8 by the first spring, the switching gear 171 is moved rightward when the pushing member 175 is moved rightward. When the switching lever 176 is engaged with the second stopper 181, the switching gear 171 is thereby kept in engagement with the receiving gear 172B. That is, the switching mechanism 170 is kept in the second state (see FIG. 4B). The switching mechanism 170 is changed from the first state to the second state in a manner described above.

As illustrated in FIG. 4B, the switching lever 176 is moved rightward against the urging force of the second spring when the switching lever 176 is pushed by the carriage 23 moving rightward in the state in which the switching gear 171 is in engagement with the receiving gear 172B, that is, in the second state of the switching mechanism 170. As a result, the pushing member 175 is moved rightward with the switching lever 176. Since the switching gear 171 is urged in the right direction 8 by the first spring, the switching gear 171 is moved rightward when the pushing member 175 is moved rightward. In this movement, the switching lever 176 is moved along the inclined surface 182 so as to be rotated such that a protruding distal end, i.e., an upper end, of the switching lever 176 is moved rearward.

When the switching lever 176 is located to the right of the second stopper 181, the carriage 23 is kept in contact with the switching lever 176 to prevent the switching gear 171 from being moved leftward by the urging force of the second spring.

When the carriage 23 is moved leftward off the switching lever 176 in a state in which the switching lever 176 is in contact with the inclined surface 182 at a position located to the right of the position of the switching lever 176 illustrated in FIG. 4B, the switching lever 176 is moved leftward by the urging force of the second spring. In this movement, as described above, the switching lever 176 is rotated such that its protruding distal end is moved rearward. Thus, the switching lever 176 is moved to a position located to the left of the second stopper 181 without engagement with the second stopper 181. As a result, the switching lever 176 is moved leftward until the switching lever 176 is brought into contact with the first stopper 180. In this movement, the switching gear 171 is moved leftward by being pushed by the pushing member 175 and is engaged with the receiving gear 172A (see FIG. 4A). That is, the switching mechanism 170 is kept in the first state. The switching mechanism 170 is changed from the second state to the first state in a manner described above.

When being moved leftward, the switching lever 176 is moved along an inclined surface 183 formed on the edge portion of the opening 179 near the first stopper 180. This movement rotates the switching lever 176 such that its protruding distal end is moved frontward.

First Transmitter 74

The forward rotation of the conveying motor 102 which is transmitted via the shaft 60A of the conveying roller 60 is transmitted to the output roller 62 and the reversible roller 45 by the first transmitter 74 illustrated in FIGS. 5A-6B. As illustrated in FIG. 7, the first transmitter 74 is provided to the left of the first conveyance path 65. That is, the first transmitter 74 transmits the rotation from a left side of the output roller 62 (as one example of one of opposite sides of the first roller in its axial direction) to the output roller 62. It is noted that the position of the first transmitter 74 is not limited to the position thereof illustrated in FIG. 7. For example, the first transmitter 74 may be provided to the right of the first conveyance path 65.

As illustrated in FIGS. 5A-6B, the first transmitter 74 includes: gears 75, 76 engaged with each other; pulleys 77-80; endless belts 81, 82; and a one-way clutch 83. The pulley 77 is one example of a first pulley. The pulley 78 is one example of a second pulley. The pulley 79 is one example of a third pulley. The pulley 80 is one example of a fourth pulley. The belt 81 is one example of a first belt. The belt 82 is one example of a second belt.

The gear 75 is engaged with the gear 76 and rotated together with the shaft 60A of the conveying roller 60. The gear 76 and the pulley 77 are rotated coaxially and together with each other. That is, the pulley 77 is rotated in conjunction with the rotation of the conveying roller 60. The pulley 78 is mounted on a shaft 62A of the output roller 62, with the one-way clutch 83 therebetween. That is, the output roller 62 is rotated in conjunction with rotation of the pulley 78.

The one-way clutch 83 is rotated together with the output roller 62 upon receiving the forward rotation of the conveying motor 102. That is, the forward rotation of the conveying motor 102 which is transmitted to the pulley 78 is transmitted to the shaft 62A of the output roller 62 and the pulley 79 by the one-way clutch 83. The one-way clutch 83 is idled with respect to the output roller 62 when the reverse rotation of the conveying motor 102 is transmitted to the one-way clutch 83. That is, the reverse rotation of the conveying motor 102 which is transmitted to the pulley 78 is not transmitted to the shaft 62A of the output roller 62 and the pulley 79 by the one-way clutch 83. It is noted that a well-known one-way clutch is used as the one-way clutch 83.

The pulley 79 is rotated together with the shaft 62A of the output roller 62. That is, the pulley 79 is rotated in conjunction with the rotation of the pulley 78. The pulley 80 is rotated together with a shaft 45A of the reversible roller 45. That is, the reversible roller 45 is rotated in conjunction with rotation of the pulley 80.

The belt 81 is looped over the pulleys 77, 78. The belt 82 is looped over the pulleys 79, 80.

Figure 5B:
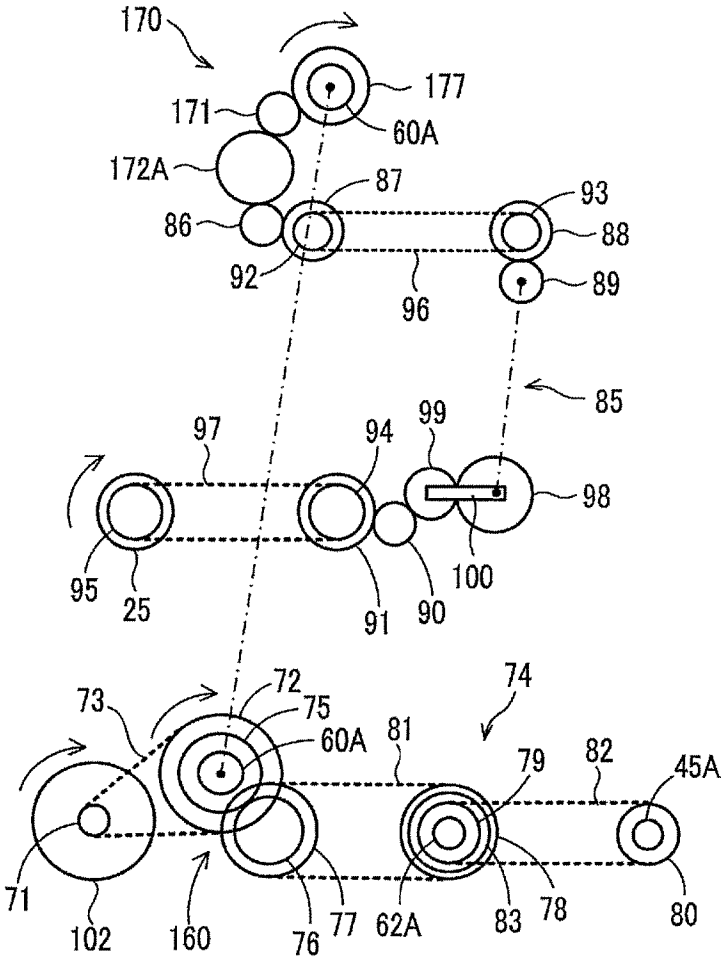
FIG. 5B is a schematic view of the first transmitter and the third transmitter, with the conveying motor being rotated reversely.
Figure 5A:
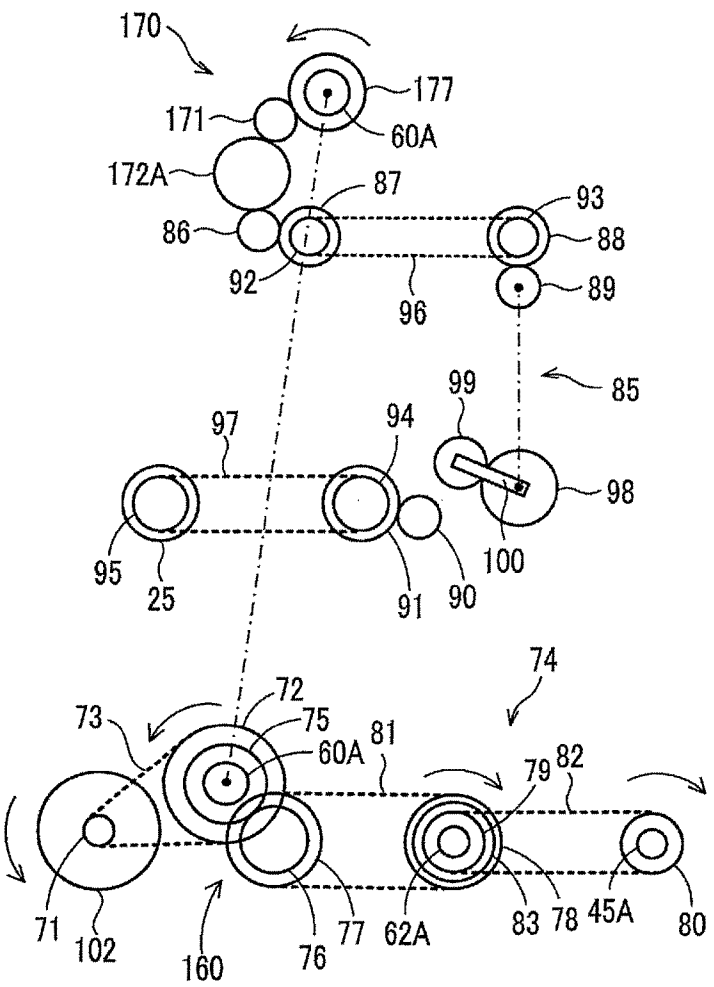
FIG. 5A is a schematic view of a first transmitter and a third transmitter, with a conveying motor being rotated forwardly.

As illustrated in FIG. 5A, the first transmitter 74 transmits the forward rotation of the conveying motor 102 from the conveying roller 60 to the output roller 62 and the reversible roller 45 to rotate the rollers 62, 45 forwardly. As illustrated in FIG. 5B, the first transmitter 74 does not transmit the reverse rotation of the conveying motor 102 from the conveying roller 60 to the output roller 62 and the reversible roller 45.

In view of the above, when the forward rotation of the conveying motor 102 is transmitted to the output roller 62 via the first transmitter 74, the output roller 62 is rotated in such a direction that the sheet 12 nipped between the output roller 62 and the spur 63 is to be conveyed in the first conveying direction 16A. When the forward rotation of the conveying motor 102 is transmitted to the reversible roller 45 via the first transmitter 74, the reversible roller 45 is rotated in such a direction that the sheet 12 nipped between the reversible roller 45 and the spur 46 is to be conveyed in the first conveying direction 16A. As a result, the sheet 12 is discharged onto the output tray 21.

Second Transmitter 149

Figure 6B:
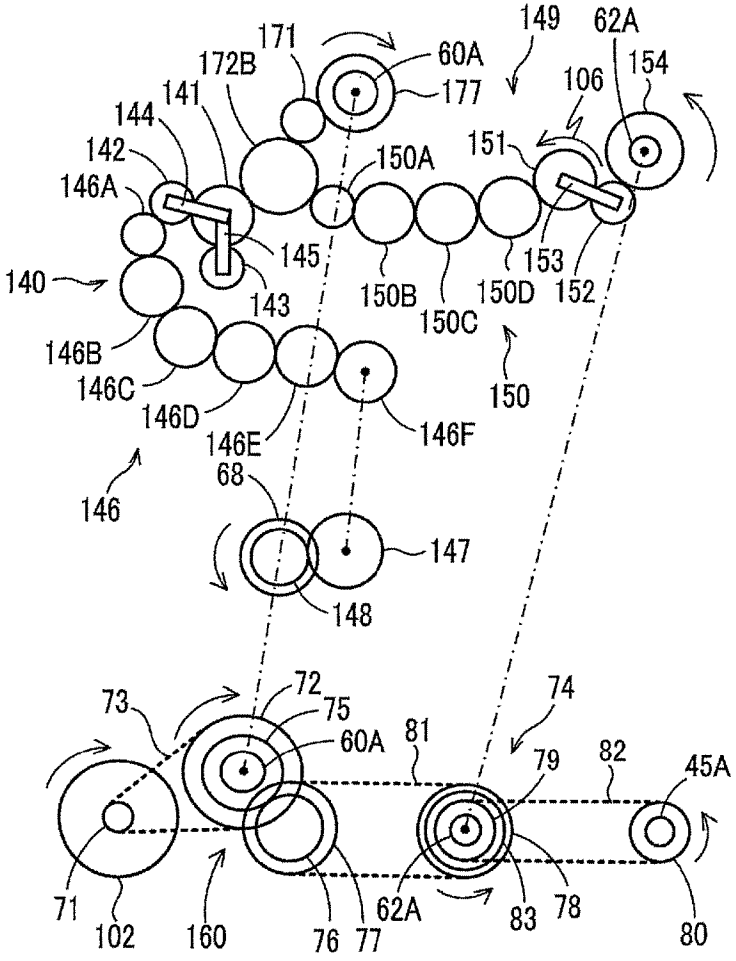
FIG. 6B is a schematic view of the first transmitter, the second transmitter, and the fourth transmitter, with the conveying motor being rotated reversely.
Figure 6A:
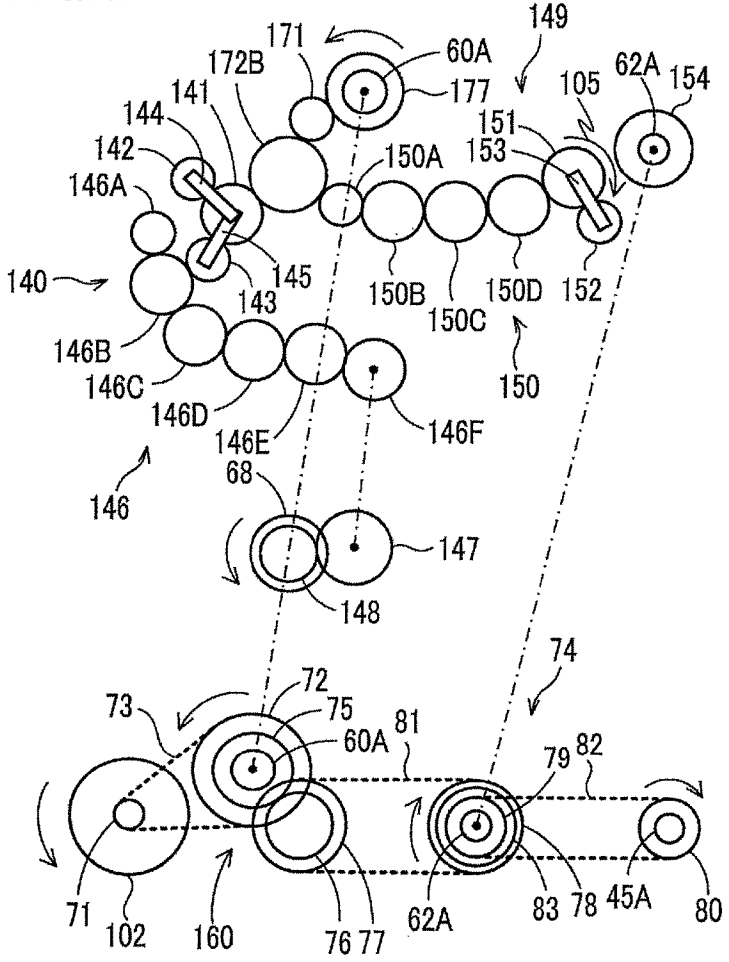
FIG. 6A is a schematic view of the first transmitter, a second transmitter, and a fourth transmitter, with the conveying motor being rotated forwardly.

The reverse rotation of the conveying motor 102 which is transmitted via the shaft 60A of the conveying roller 60 and the switching mechanism 170 being in the second state is transmitted to the output roller 62 and the reversible roller 45 by the second transmitter 149 illustrated in FIGS. 6A and 6B. As illustrated in FIG. 7, the second transmitter 149 is provided to the right of the first conveyance path 65. That is, the second transmitter 149 transmits the rotation from a right side of the output roller 62 (as one example of the other of opposite sides of the first roller in its axial direction) to the output roller 62. It is noted that the position of the second transmitter 149 is not limited to the position thereof illustrated in FIG. 7. For example, the second transmitter 149 may be provided to the left of the first conveyance path 65. In the case where the second transmitter 149 is provided to the left of the first conveyance path 65, the first transmitter 74 is preferably provided to the right of the first conveyance path 65.

As illustrated in FIGS. 6A and 6B, the second transmitter 149 includes a gear train 150, a sun gear 151, a planetary gear 152, an arm 153, a gear 154 (as one example of a transmission gear), the pulleys 79, 80, and the belt 82. The pulleys 79, 80 and the belt 82 are included in both of the first transmitter 74 and the second transmitter 149.

The gear train 150 includes a plurality of gears 150A-150D. Each adjacent two of the gears 150A-150D are engaged with each other. The gear 150A is engaged with the receiving gear 172B. The sun gear 151 is engaged with the gear 150D. The planetary gear 152 is engaged with the sun gear 151 and moved into and out of contact with the gear 154. The arm 153 is pivotably supported on the sun gear 151 at its one end. The arm 153 supports the planetary gear 152 at the other end such that the planetary gear 152 can be rotated on its axis and revolved around the sun gear 151. Thus, when the sun gear 151 is rotated, the planetary gear 152 is revolved around the sun gear 151 while rotating on the axis of the planetary gear 152. The gear 154 is rotated together with the shaft 62A of the output roller 62. That is, the gear 154 transmits, to the output roller 62, the rotation of the conveying motor 102 which is transmitted from the planetary gear 152 engaged with the gear 154.

When the forward rotation of the conveying motor 102 is transmitted to the sun gear 151, the sun gear 151 is rotated in a first rotational direction 105 indicated by the arrow in FIG. 6A. This rotation causes the planetary gear 152 to be revolved in the first rotational direction 105 and moved off and away from the gear 154. As a result, the second transmitter 149 does not transmit the forward rotation of the conveying motor 102 from the conveying roller 60 to the output roller 62 and the reversible roller 45.

When the reverse rotation of the conveying motor 102 is transmitted to the sun gear 151, the sun gear 151 is rotated in a second rotational direction 106 that is indicated by the arrow in FIG. 6B and reverse to the first rotational direction 105. This rotation causes the planetary gear 152 to be revolved in the second rotational direction 106 and engaged with the gear 154. As a result, the second transmitter 149 transmits the reverse rotation of the conveying motor 102 from the conveying roller 60 to the output roller 62 and the reversible roller 45 to rotate the rollers 62, 45 reversely.

When the reverse rotation of the conveying motor 102 is transmitted to the reversible roller 45 via the second transmitter 149, the reversible roller 45 is rotated in such a direction that the sheet 12 nipped between the reversible roller 45 and the spur 46 is conveyed in a direction reverse to the first conveying direction 16A. In this case, when the flap 49 is in the normal state, the sheet 12 is guided to the second conveyance path 66 such that the upstream end of the sheet 12 in the first conveying direction 16A serves as a leading end, and the sheet 12 is conveyed in the second conveying direction 16B through the second conveyance path 66.

The second transmitter 149 includes a speed reducer configured to reduce the speed of the rotation of the conveying roller 60 and transmit the rotation to the output roller 62. This speed reduction enables the speed of the rotation of the re-conveying roller 68 to be greater than the speed of the rotation of the output roller 62 and the reversible roller 45. This construction can prevent the sheet 12 from being bent on the second conveyance path 66 at a position located between the re-conveying roller 68 and the reversible roller 45. In the case where the sheet 12 is nipped by both of the reversing device 56 and the re-conveying unit 57 in the state in which the reversible roller 45 is rotated forwardly, both of the reversing device 56 and the re-conveying unit 57 pull the sheet 12. Even in case where both of the reversing device 56 and the re-conveying unit 57 pull the sheet 12, the sheet 12 can be guided to the second conveyance path 66 by the re-conveying roller 68 with the higher speed of the rotation.

In the present embodiment, the speed reducer is constituted by (i) the gear 150A located on the most upstream side in a direction in which the rotation is transmitted from the conveying roller 60 to the output roller 62 in the second transmitter 149 and (ii) the gear 154 located on the most downstream side in the direction in which the rotation is transmitted from the conveying roller 60 to the output roller 62 in the second transmitter 149. A ratio between the number n1 of teeth of the gear 150A and the number n2 of teeth of the gear 154 (n2/n1) is greater than one. It is noted that the construction of the speed reducer is not limited to the construction described above. For example, the distance between teeth of any of the gears of the second transmitter 149 (e.g., the gear 150B) may be greater than the distance between teeth of the other of the gears of the second transmitter 149 (i.e., the gears of the second transmitter 149 other than the gear 150B). In this case, the gear 150B serves as the speed reducer. The distance between teeth of any one of the gears different from the gear 150B may be greater than the distance between teeth of the other gears.

Third Transmitter 85

The rotation of the conveying motor 102 which is transmitted via the shaft 60A of the conveying roller 60 and the switching mechanism 170 being in the first state is transmitted to the supply roller 25 via the third transmitter 85 illustrated in FIGS. 5A and 5B. As illustrated in FIG. 5, the third transmitter 85 includes gears 86-91, pulleys 92-95, endless belts 96, 97, a sun gear 98, a planetary gear 99, and an arm 100.

The gear 86 is in engagement with the receiving gear 172A and the gear 8. The gear 87 and the pulley 92 are rotated coaxially and together with each other. The gear 88 and the pulley 93 are rotated coaxially and together with each other. The gear 89 is in engagement with the gear 88. The sun gear 98 and the gear 89 are rotated coaxially and together with each other. The planetary gear 99 is engaged with the sun gear 98 and moved into and out of contact with the gear 90. The arm 100 is pivotably supported on the sun gear 98 at its one end. The arm 100 supports the planetary gear 99 at the other end such that the planetary gear 99 can be rotated on its axis and revolved around the sun gear 98. Thus, when the sun gear 98 is rotated, the planetary gear 99 is revolved around the sun gear 98 while rotating on the axis of the planetary gear 99. The gear 90 is in engagement with the gear 91. The gear 91 and the pulley 94 are rotated coaxially and together with each other. The pulley 95 and the supply roller 25 are rotated coaxially and together with each other. The belt 96 is looped over the pulleys 92, 93. The belt 97 is looped over the pulleys 94, 95.

As illustrated in FIG. 5A, when the forward rotation of the conveying motor 102 is transmitted to the sun gear 98, the planetary gear 99 is moved off and away from the gear 90. As a result, the third transmitter 85 transmits the forward rotation of the conveying motor 102 to the supply roller 25. As illustrated in FIG. 5B, when the reverse rotation of the conveying motor 102 is transmitted to the sun gear 98, the planetary gear 99 is engaged with the gear 90. As a result, the third transmitter 85 transmits the reverse rotation of the conveying motor 102 to the supply roller 25 to forwardly rotate the supply roller 25.

Fourth Transmitter 140

The rotation of the conveying motor 102 which is transmitted via the shaft 60A of the conveying roller 60 and the switching mechanism 170 being in the second state is transmitted to the re-conveying roller 68 by the fourth transmitter 140 illustrated in FIG. 6. As illustrated in FIG. 6, the fourth transmitter 140 includes a sun gear 141, planetary gears 142, 143, arms 144, 145, a gear train 146, and gears 147, 148.

The sun gear 141 is engaged with the receiving gear 172B. The planetary gear 142 is engaged with the sun gear 141 and moved into and out of contact with a gear 146A. The planetary gear 143 is engaged with the sun gear 141 and moved into and out of contact with a gear 146B. The arm 144 is pivotably supported on the sun gear 141 at its one end. The arm 144 supports the planetary gear 142 at the other end such that the planetary gear 142 can be rotated on its axis and revolved around the sun gear 141. The arm 145 is pivotably supported on the sun gear 141 at its one end. The arm 145 supports the planetary gear 143 at the other end such that the planetary gear 143 can be rotated on its axis and revolved around the sun gear 141. The gear train 146 includes a plurality of gears 146A-146F. Each adjacent two of the gears 146A-146F are engaged with each other. The gear 147 and the gear 146F are rotated coaxially and together with each other. The gear 148 is engaged with the gear 147. The gear 148 and a shaft of the re-conveying roller 68 are rotated coaxially and together with each other.

As illustrated in FIG. 6A, when the forward rotation of the conveying motor 102 is transmitted to the sun gear 141, the planetary gear 142 is moved off and away from the gear 146A, so that the planetary gear 143 is engaged with the gear 146B. That is, the forward rotation of the conveying motor 102 is transmitted from the conveying roller 60 to the re-conveying roller 68 via the gears 146B-146F. As illustrated in FIG. 6B, when the reverse rotation of the conveying motor 102 is transmitted to the sun gear 141, the planetary gear 142 is engaged with the gear 146A, and the planetary gear 143 is moved off and away from the gear 146B. That is, the reverse rotation of the conveying motor 102 is transmitted from the conveying roller 60 to the re-conveying roller 68 via the gears 146A-146F. With this construction, the re-conveying roller 68 is rotated forwardly even in the case where any of the forward rotation and the reverse rotation of the conveying motor 102 is transmitted to the re-conveying roller 68. The sheet 12 nipped between the re-conveying roller 68 and the driven roller 69 is conveyed in the second conveying direction 16B by the forward rotation of the re-conveying roller 68.

Transmission Delayer 160

As illustrated in FIGS. 5A-6B, the first transmitter 74 includes a transmission delayer 160. In the present embodiment, the transmission delayer 160 includes the gear 76 (as one example of a second rotary member) and the pulley 77 (as one example of a first rotary member).

Figure 10A:
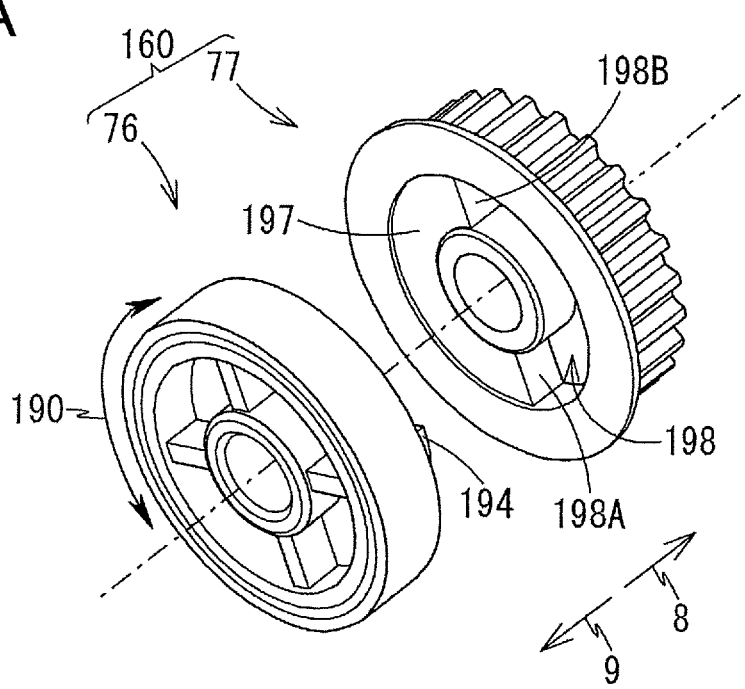
FIGS. 10A and 10B are perspective views of a transmission delayer.
Figure 10B:
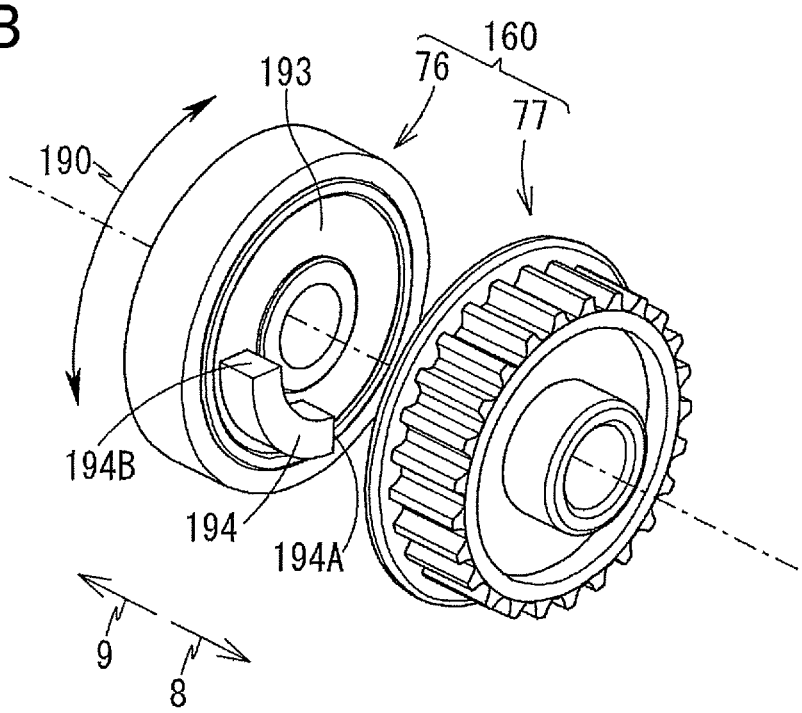

There will be next explained a construction of the transmission delayer 160 with reference to FIGS. 10A and 10B. It is noted that FIGS. 10A and 10B omit illustration of teeth formed on the gear 76.

The gear 76 is rotatably supported on a support shaft, not illustrated, extending in the right and left directions 8, 9. Like the gear 76, the pulley 77 is rotatably supported on the support shaft. That is, the pulley 77 and the gear 76 are rotated coaxially.

A protrusion 194 (as one example of a contact portion) protruding in the right direction 8 is provided on a right surface 193 of the gear 76. In other words, the protrusion 194 protruding toward the pulley 77 is provided on the surface (the right surface 193) of the gear 76 which faces the pulley 77. One end surface 194A of the protrusion 194 in circumferential directions 190 is contactable with a side surface 198A of a recessed portion 198 of the pulley 77. The other end surface 194B of the protrusion 194 in the circumferential directions 190 is contactable with a side surface 198B of the recessed portion 198 of the pulley 77. That is, the length of the protrusion 194 in the circumferential directions 190 is equal to a distance in the circumferential directions 190 between (i) the one end surface 194A of the protrusion 194 which contacts the side surface 198A and (ii) the other end surface 194B of the protrusion 194 which contacts the side surface 198B.

The pulley 77 has a left surface 197 that faces the gear 76. The left surface 197 has the recessed portion 198. The recessed portion 198 extends in the circumferential directions 190. One end of the recessed portion 198 in the circumferential directions 190 is defined by the side surface 198A as one example of a first surface. The other end of the recessed portion 198 in the circumferential directions 190 is defined by the side surface 198B as one example of a second surface. The distance between the side surfaces 198A, 198B in the circumferential directions 190 is longer than the length of the protrusion 194 in the circumferential directions 190.

The gear 76 and the pulley 77 are arranged in a state in which the right surface 193 of the gear 76 and the left surface 197 of the pulley 77 face each other. In this state, the protrusion 194 is inserted in the recessed portion 198. That is, the protrusion 194 is located between the side surfaces 198A, 198B of the recessed portion 198 in the circumferential directions 190.

With the constructions described above, the gear 76 and the pulley 77 are rotated as follows.

When the forward rotation of the conveying motor 102 is transmitted to the gear 76, the gear 76 is rotated forward in such a direction that the protrusion 194 is to be moved toward the side surface 198A. When the reverse rotation of the conveying motor 102 is transmitted to the gear 76, the gear 76 is rotated reversely in such a direction that the protrusion 194 is to be moved toward the side surface 198B. The side surface 198A of the pulley 77 is pressed by the protrusion 194 of the gear 76 being rotated forwardly, and thereby the pulley 77 is rotated forwardly together with the gear 76. The side surface 198B of the pulley 77 is pressed by the protrusion 194 of the gear 76 being rotated reversely, and thereby the pulley 77 is rotated reversely together with the gear 76.

When the forward rotation is transmitted from the conveying motor 102 to the conveying roller 60, the protrusion 194 is in contact with the side surface 198A. When the rotation transmitted from the conveying motor 102 to the conveying roller 60 is changed from the forward rotation to the reverse rotation in this state, the gear 76 having received the reverse rotation of the conveying motor 102 is rotated reversely in such a direction that the protrusion 194 is to be moved away from the side surface 198A and toward the side surface 198B. During this rotation, the gear 76 is idled with respect to the pulley 77. That is, the pulley 77 is not rotated during the reverse rotation of the gear 76 until the protrusion 194 is brought into contact with the side surface 198B from the start of the reverse rotation of the gear 76. As a result, the reverse rotation of the conveying motor 102 is not transmitted to the output roller 62 during the idle of the gear 76 with respect to the pulley 77. When the protrusion 194 is brought into contact with the side surface 198B by the reverse rotation of the gear 76 so as to push the side surface 198B, the pulley 77 is rotated reversely together with the gear 76. As a result, the reverse rotation of the conveying motor 102 is transmitted to the output roller 62.

When the reverse rotation is transmitted from the conveying motor 102 to the conveying roller 60, the protrusion 194 is in contact with the side surface 198B. When the rotation transmitted from the conveying motor 102 to the conveying roller 60 is changed from the reverse rotation to the forward rotation in this state, the gear 76 having received the forward rotation of the conveying motor 102 is rotated forwardly in such a direction that the protrusion 194 is to be moved away from the side surface 198B and toward the side surface 198A. During this rotation, the gear 76 is idled with respect to the pulley 77. That is, the pulley 77 is not rotated during the forward rotation of the gear 76 until the protrusion 194 is brought into contact with the side surface 198A from the start of the forward rotation of the gear 76. As a result, the forward rotation of the conveying motor 102 is not transmitted to the output roller 62 during the idle of the gear 76 with respect to the pulley 77. When the protrusion 194 is brought into contact with the side surface 198A by the forward rotation of the gear 76 so as to push the side surface 198A, the pulley 77 is rotated forwardly together with the gear 76. As a result, the forward rotation of the conveying motor 102 is transmitted to the output roller 62.

In summary, in any of the case where the rotation transmitted from the conveying motor 102 to the conveying roller 60 is changed from the forward rotation to the reverse rotation and the case where the rotation transmitted from the conveying motor 102 to the conveying roller 60 is changed from the reverse rotation to the forward rotation, the transmission delayer 160 does not transmit the rotation of the conveying motor 102 from the conveying roller 60 to the output roller 62 during rotation of the conveying motor 102 by a particular amount. Here, the particular amount of the rotation is an amount of rotation of the conveying motor 102 during a period extending from a point in time when the protrusion 194 is moved off one of the side surfaces 198A, 198B and brought into contact with the other of the side surfaces 198A, 198B.

While the gear 76 includes the one protrusion, and the pulley 77 has the one recess in the present embodiment, a plurality of protrusions and a plurality of recesses may be provided.

While the gear 76 includes the protrusion, and the pulley 77 has the recess to which the protrusion is inserted in the present embodiment, the MFP 10 may be configured such that the pulley 77 includes the protrusion, and the gear 76 has the recess to which the protrusion is inserted.

While the gear 76 includes the protrusion, and the pulley 77 has the recess to which the protrusion is inserted in the present embodiment, the MFP 10 may have any configuration as long as a protrusion provided on one of the gear 76 and the pulley 77 is inserted in a space defined between two surfaces which are provided on the other of the gear 76 and the pulley 77 so as to be spaced apart from each other in the circumferential directions 190.

For example, the MFP 10 may be configured such that each of the gear 76 and the pulley 77 includes two protrusions spaced apart from each other in the circumferential directions 190, and one of the protrusions of one of the gear 76 and the pulley 77 is inserted in a space defined between side surfaces of the two protrusions of the other of the gear 76 and the pulley 77, which surfaces face each other. In this construction, the side surfaces facing each other are another example of the first surface and the second surface.

The transmission delayer 160 is constituted by the gear 76 and the pulley 77 in the present embodiment but may be constituted by a gear and a pulley different from the gear 76 and the pulley 77. For example, the transmission delayer 160 may be constituted by the pulley 78 and the pulley 79. In this example, the construction of the pulley 78 is the same as that of one of the gear 76 and the pulley 77, and the construction of the pulley 79 is the same as that of the other of the gear 76 and the pulley 77.

The transmission delayer 160 may not include the two rotary members adjacent to each other, as long as the transmission delayer 160 is constructed such that, when the direction of the rotation transmitted from the conveying motor 102 to the conveying roller 60 is switched, the rotation of the conveying motor 102 is not transmitted from the conveying roller 60 to the output roller 62 during the rotation of the conveying motor 102 by the particular amount.

For example, the transmission delayer 160 may be similar in construction to the planetary gear mechanism included in the second transmitter 149 (the sun gear 151, the planetary gear 152, and the arm 153). In this example, the gear 75 and the gear 76 are not in engagement with each other, and a planetary gear mechanism is disposed between the gear 75 and the gear 76. A sun gear of the planetary gear mechanism is engaged with the gear 75, and a planetary gear of the planetary gear mechanism is moved into and out of contact with the gear 76. It is noted that the planetary gear mechanism is disposed such that the planetary gear is engaged with the gear 76 when the forward rotation is transmitted from the conveying motor 102 to the conveying roller 60, and the planetary gear is moved off and away from the gear 76 when the reverse rotation is transmitted from the conveying motor 102 to the conveying roller 60. As a result, when the rotation transmitted from the conveying motor 102 to the conveying roller 60 is changed from the reverse rotation to the forward rotation, the planetary gear mechanism as the transmission delayer 160 does not transmit the rotation of the conveying motor 102 from the conveying roller 60 to the output roller 62 during rotation of the conveying motor 102 by a particular amount. This particular amount of the rotation is an amount of rotation of the conveying motor 102 during a period in which the planetary gear spaced apart from the gear 76 is engaged with the gear 76 by revolving around the sun gear.

Controller 130

As illustrated in FIG. 8, the controller 130 includes a CPU 131, a ROM 132, a RAM 133, an EEPROM 134, and an ASIC 135 which are connected to each other by an internal bus 137. The ROM 132 stores programs and information to be used by the CPU 131 to control various operations. The RAM 133 is used as a working area for data processing or as a storage area for temporarily storing data, signals, and the like to be used by the CPU 131 to execute the above-described programs. The EEPROM 134 stores settings, flags, and the like to be kept also after the MFP 10 is turned off.

The conveying motor 102 and the carriage motor 103 are connected to the ASIC 135. The ASIC 135 creates drive signals for rotating the motors to control the motors based on the created signals. Each of the motors is rotated forwardly or reversely based on the drive signals created by the ASIC 135. For example, the controller 130 controls the conveying motor 102 to rotate the rollers. The controller 130 controls the carriage motor 103 to reciprocate the carriage 23. The controller 130 controls the recording head 39 to eject the ink from the nozzles 40.

The first sensor 120, the rotary encoder 121, and the second sensor 122 are connected to the ASIC 135. The controller 130 detects the presence of the sheet 12 at each of the first sensor 120 and the second sensor 122 based on detection signal output from the sensor. The controller 130 detects the position of the sheet 12 based on the detection signal output from the first sensor 120 and the pulse signal output from the rotary encoder 121.

Image Recording Process

Figure 9:
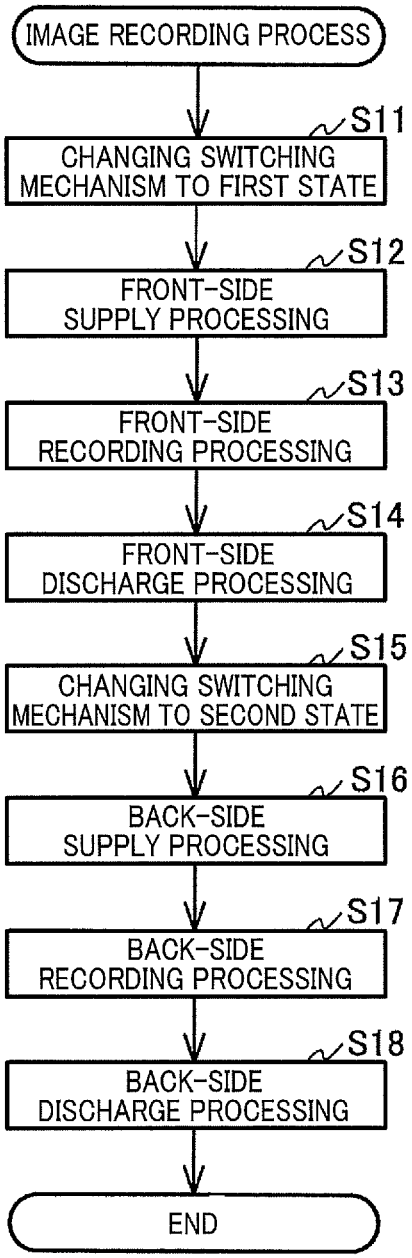
FIG. 9 is a flow chart illustrating an image recording process.

There will be next explained an image recording process in the present embodiment with reference to FIG. 9. This image recording process is executed by the CPU 131 of the controller 130. It is noted that the processings may be executed by the CPU 131 reading the programs stored in the ROM 132 and may be executed by hardware circuits mounted on the controller 130.

The controller 130 executes the image recording process upon receiving a recording instruction that is input by a user to record images on both sides of the sheet. The recording instruction may be obtained in any manner. For example, the recording instruction may be obtained via an input device 17 provided on the MFP 10 (see FIG. 1) and may be obtained from an external device over a communication network. The controller 130 controls the rollers, the carriage 23, and the recording head 39 according to the obtained recording instruction to record images on the sheet 12.

FIG. 9 illustrates the flow of the image recording process. This flow begins with S11 at which the controller 130 switches the switching mechanism 170 to the first state. Specifically, the controller 130 controls the carriage 23 to move in the right and left directions 8, 9 to bring the switching lever 176 into contact with the first stopper 180. As a result, the switching gear 171 is moved to engage the switching gear 171 and the receiving gear 172A with each other. In the case where the switching mechanism 170 has already been in the first state, however, the controller 130 executes processings at S12 and subsequent steps without executing the processing at S11.

The controller 130 at S12 executes a front-side supply processing for supplying the sheet 12 for recoding on a front surface of the sheet 12. In this front-side supply processing, the leading end of the sheet 12 supported on the supply tray 20 (the downstream end of the sheet 12 in the first conveying direction 16A) is moved to the conveying unit 54. Specifically, the controller 130 causes the reverse rotation of the conveying motor 102 to rotate the supply roller 25.

The controller 130 at S13 executes a front-side recording processing for image recording on the front surface of the sheet 12. In this front-side recording processing, an image is recorded on the front surface of the sheet 12. Specifically, the controller 130 at S13 alternately repeats a conveyance processing and an ejection processing. In the conveyance processing, the sheet 12 having reached the conveying unit 54 is conveyed by at least one of the conveying unit 54, the sheet discharger 55, and the reversing device 56 by a predetermined linefeed distance in the first conveying direction 16A. In the ejection processing, the ink is ejected by the recording head 39 onto the sheet 12 conveyed by the predetermined linefeed distance.

Specifically, the controller 130 causes the forward rotation of the conveying motor 102 in the conveyance processing to rotate the rollers 60, 62, 45 forwardly. It is noted that the forward rotation of the conveying motor 102 is transmitted from the conveying roller 60 to the output roller 62 and the reversible roller 45 via the first transmitter 74. In the ejection processing, the controller 130 drives the carriage motor 103 to move the carriage 23 in the right and left directions 8, 9 and controls the recording head 39 to eject the ink at predetermined timings.

The controller 130 at S14 executes a front-side discharge processing for the sheet 12. In this front-side discharge processing, at least one of the conveying unit 54, the sheet discharger 55, and the reversing device 56 conveys the sheet 12, on which the image has been recorded on its front surface, in the first conveying direction 16A such that the trailing end of the sheet 12, i.e., the upstream end of the sheet 12 in the first conveying direction 16A reaches the branch position 66A. Specifically, the controller 130 causes the forward rotation of the conveying motor 102 to rotate the rollers 60, 62, 45 forwardly. In this rotation, the flap 49 is raised by the sheet 12 conveyed in the first conveying direction 16A and thereby swung from the flip position to the discharge position. When the trailing end of the sheet 12 has reached the branch position 66A, the flap 49 is swung from the discharge position to the flip position by its own weight. This operation turns the trailing end of the sheet 12 toward the second conveyance path 66.

The controller 130 at S15 switches the switching mechanism 170 from the first state to the second state. Specifically, the controller 130 controls the carriage 23 to move in the right direction 8 to bring the switching lever 176 into contact with the second stopper 181. As a result, the switching gear 171 is moved to engage the switching gear 171 and the receiving gear 172B with each other.

The controller 130 at S16 executes a back-side supply processing. In this back-side supply processing, the sheet 12 on which the image has been recorded is turned upside down and conveyed to the conveying unit 54. Specifically, the controller 130 causes the reverse rotation of the conveying motor 102 to rotate the reversible roller 45 reversely and rotate the re-conveying roller 68 forwardly. As a result, the sheet 12 is conveyed from the branch position 66A into the second conveyance path 66, with the upstream end of the sheet 12 in the first conveying direction 16A as a leading end, and the sheet 12 is then conveyed to the conveying unit 54 via the merge position 66B. It is noted that the reverse rotation of the conveying motor 102 is transmitted from the conveying roller 60 to the output roller 62 and the reversible roller 45 via the second transmitter 149 and from the conveying roller 60 to the re-conveying roller 68 via the fourth transmitter 140.

The controller 130 at S17 executes a back-side recording processing for image recording on a back surface of the sheet 12. In this back-side recording processing, an image is recorded on the back surface of the sheet 12. In this back-side recording processing, as in the front-side recording processing, the controller 130 alternately repeats the conveyance processing and the ejection processing.

The controller 130 causes the forward rotation of the conveying motor 102 in the conveyance processing of the back-side recording processing. As a result, the forward rotation of the conveying motor 102 is transmitted from the conveying roller 60 to the output roller 62 and the reversible roller 45 via the first transmitter 74 to rotate the rollers 60, 62, 45 forwardly. That is, the controller 130 switches the rotation of the conveying motor 102 from the reverse rotation performed in the back-side supply processing to the forward rotation in the conveyance processing. This switch of the rotation of the conveying motor 102 is performed before the sheet 12 reaches the conveying unit 54 via the merge position 66B. Thus, the conveying unit 54 can convey the sheet 12 in the first conveying direction 16A when the sheet 12 reaches the conveying unit 54. Also, even when the rotation of the conveying motor 102 is switched from the reverse rotation to the forward rotation, the re-conveying roller 68 continues to be rotated forwardly. Thus, the sheet 12 is normally conveyed along the second conveyance path 66.

In the above-described switch of the rotation of the conveying motor 102 from the reverse rotation to the forward rotation, the forward rotation of the conveying motor 102 is transmitted to the second transmitter 149, whereby the planetary gear 152 is moved off and away from the gear 154. When the rotation of the conveying motor 102 is switched from the reverse rotation to the forward rotation, the forward rotation of the conveying motor 102 is transmitted from the conveying roller 60 to the output roller 62 via the first transmitter 74. In this transmission, the transmission delayer 160 delays the timing at which the forward rotation of the conveying motor 102 becomes transmittable from the conveying roller 60 to the output roller 62 via the first transmitter 74. As a result, this timing can be set to a timing after the planetary gear 152 is moved off the gear 154.

The controller 130 at S18 executes a back-side discharge processing. In this back-side discharge processing, the sheet 12 is conveyed in the first conveying direction 16A by the sheet discharger 55 and the reversing device 56 until the sheet 12 passes through the reversing device 56 (that is, until the sheet 12 is discharged onto the output tray 21). Specifically, the controller 130 causes the forward rotation of the conveying motor 102 to rotate the rollers 60, 62, 45 forwardly.

Effects

In the above-described embodiment, when the rotation of the conveying motor 102 which is transmitted from the conveying motor 102 to the conveying roller 60 is changed from the reverse rotation to the forward rotation, the transmission delayer 160 delays the timing at which the forward rotation of the conveying motor 102 becomes transmittable from the conveying roller 60 to the output roller 62 via the first transmitter 74. With this operation, the timing at which the forward rotation of the conveying motor 102 becomes transmittable to the gear 154 via the first transmitter 74 and the output roller 62 becomes later than the timing at which the planetary gear 152 is moved off the gear 154. That is, it is possible to prevent the gear 154 from being rotated by the forward rotation of the conveying motor 102 in the state in which the gear 154 is in engagement with the planetary gear 152. This configuration enables the planetary gear 152 to be moved off the gear 154, thereby preventing occurrence of situation in which the conveying motor 102 cannot be rotated because the conveying motor 102 is locked.

In the above-described embodiment, the transmission delayer 160 is constituted by the pulley 77 and the gear 76. Thus, the transmission delayer 160 can be constructed with a simple structure.

In the above-described embodiment, the first transmitter 74 includes the one-way clutch 83, thereby simplifying the construction of the first transmitter 74.

In the above-described embodiment, it is possible to stop the output roller 62 while rotating the conveying roller 60 by establishing the first state of the switching mechanism 170. For example, it is possible to stop the output roller 62 while rotating the conveying roller 60 in the direction in which the sheet 12 is conveyed in the direction reverse to the first conveying direction 16A. With this operation, the sheet 12 being conveyed toward the conveying roller 60 is brought into contact with the conveying roller 60 being rotated in the direction in which the sheet 12 is to be conveyed in the direction reverse to the first conveying direction 16A. This contact can correct a skew of the sheet 12. In this correction, the output roller 62 is at rest even in the state in which the sheet 12 supplied before the sheet 12 in question is in contact with the output roller 62. Thus, the sheet 12 supplied before the sheet 12 in question is not conveyed by the output roller 62.

In the above-described embodiment, the first state of the switching mechanism 170 is established, and the reverse rotation of the conveying motor 102 is transmitted to the conveying roller 60, whereby the sheet 12 supported on the supply tray 20 can be supplied toward the conveying roller 60 by the supply roller 25.

In the above-described embodiment, the second state of the switching mechanism 170 is established, and the rotation of the conveying motor 102 is transmitted from the conveying roller 60 to the re-conveying roller 68 via the fourth transmitter 140, whereby the sheet 12 to be guided into the second conveyance path 66 can be conveyed along the second conveyance path 66 by the re-conveying roller 68. Also, the supply of the sheet 12 by the supply roller 25 and the conveyance of the sheet 12 along the second conveyance path 66 by the re-conveying roller 68 can be performed separately depending upon the state of the switching mechanism 170.

In the above-described embodiment, the drive-power transmitting path of the first transmitter 74 and the drive-power transmitting path of the second transmitter 149 share a path from the output roller 62 to the reversible roller 45. This configuration reduces the size of a space occupied by the first transmitter 74 and the second transmitter 149.

The speed of the rotation of the conveying roller 60 is reduced by the second transmitter 149, and the rotation is transmitted to the output roller 62. Thus, there is a possibility that the timing at which the rotation of the conveying motor 102 becomes transmittable from the conveying roller 60 to the output roller 62 via the first transmitter 74 is earlier than the timing at which the planetary gear 152 is moved off the gear 154. In the above-described embodiment, in contrast, the first transmitter 74 includes the transmission delayer 160. With this construction, the timing at which the rotation of the conveying motor 102 becomes transmittable from the conveying roller 60 to the output roller 62 via the first transmitter 74 is later than the timing at which the planetary gear 152 is moved off the gear 154.

In the above-described embodiment, the first transmitter 74 is provided to the left of the first conveyance path 65, and the second transmitter 149 is provided to the right of the first conveyance path 65. With this construction, the first transmitter 74 and the second transmitter 149 do not interfere with each other, thereby simplifying the constructions of the transmitters 74, 149.

Modifications

In the above-described embodiment, the rollers 60, 62, 45 are rotated forwardly by receiving the forward rotation of the conveying motor 102 via the first transmitter 74 and are rotated reversely by receiving the reverse rotation of the conveying motor 102 via the second transmitter 149. However, the directions of the rotation of the rollers 60, 62, 45 are not limited to the rotations in the above-described embodiment. For example, each of the rollers 60, 62, 45 may be rotated in the same direction in any of the case where the forward rotation of the conveying motor 102 is transmitted via the first transmitter 74 and the case where the reverse rotation of the conveying motor 102 is transmitted via the second transmitter 149.

The conveying roller 60 serves as the driven member in the above-described embodiment, but the present disclosure is not limited to this configuration. For example, the driven member may be a pump, not illustrated, which is driven when the ink is sucked from the nozzles 40. The pump is disposed on a tube, not illustrated, which is connected to the nozzles when the ink is sucked from the nozzles 40. The tube is connected at one end to the nozzles 40 and at the other end to a waste ink tank, not illustrated. When the pump is driven, the tube is squeezed. As a result, the ink is sucked from the nozzles 40 into the tube and transferred into the waste ink tank. In the case where the driven member is the pump, the rotation of the conveying motor 102 is transmitted from the pump to the output roller 62 by gears provided on the pump, for example.

The directions of the rotation (i.e., the forward rotation and the reverse rotation) transmitted from the conveying motor 102 to each of the rollers 25, 60, 62, 45, 68 may be reverse to those in the above-described embodiment. For example, in the above-described embodiment, the rollers 60, 62, 45 are rotated forwardly by receiving the forward rotation of the conveying motor 102 via the first transmitter 74 and are rotated reversely by receiving the reverse rotation of the conveying motor 102 via the second transmitter 149. However, the rollers 60, 62, 45 may be rotated forwardly by receiving the reverse rotation of the conveying motor 102 via the first transmitter 74 and are rotated reversely by receiving the forward rotation of the conveying motor 102 via the second transmitter 149.

The second conveyance path 66 may have a construction different from that illustrated in FIG. 2 as long as the sheet 12 on which an image has been recorded by the image recorder 24 can be turned upside down and conveyed to the image recorder 24 again. For example, the second conveyance path 66 may be defined such that the branch position 66A is located upstream of the image recorder 24 in the first conveying direction 16A, and the merge position 66B is located upstream of the branch position 66A in the first conveying direction 16A.

In the image recording process in the above-described embodiment, the transmission delayer 160 delays the transmission of the forward rotation of the conveying motor 102 via the first transmitter 74 in the conveyance processing of the back-side recording processing in the case of the both-side image recording on the sheet 12. However, the transmission of the forward rotation of the conveying motor 102 via the first transmitter 74 may not be delayed in the conveyance processing of the back-side recording processing and may be delayed in any time in the switch of the rotation of the conveying motor 102 from the forward rotation to the reverse rotation or from the reverse rotation to the forward rotation.

For example, the transmission delayer 160 may delay the transmission of the forward rotation of the conveying motor 102 via the first transmitter 74 in the case where the MFP 10 has a function for recording an image on a surface of a plate-like or disc-like recording medium such as a CD and a DVD. In this case, the recording medium is inserted from the opening 13 in the direction reverse to the first conveying direction 16A, then conveyed in the first conveying direction 16A for image recording, and finally discharged through the opening 13. The conveying motor 102 is rotated reversely when the recording medium is inserted in the direction reverse to the first conveying direction 16A, and the conveying motor 102 is rotated forwardly when the recording medium is conveyed in the first conveying direction 16A. That is, the rotation of the conveying motor 102 is switched from the reverse rotation to the forward rotation when the direction of the conveyance of the recording medium is switched. The timing of this switch is delayed by the transmission delayer 160.

What is claimed is:

1. A conveyor, comprising:

a motor that is rotated forwardly and reversely;

a driven member that is driven by rotation caused by at least one of forward rotation and reverse rotation of the motor, the caused rotation being transmitted from the motor;

a first roller provided on a first conveyance path through which a sheet is to be conveyed;

a first power transmitting mechanism configured to transmit rotation caused by one of the forward rotation and the reverse rotation of the motor to the first roller and not to transmit rotation caused by the other of the forward rotation and the reverse rotation of the motor from the driven member to the first roller; and a second power transmitting mechanism configured to transmit the rotation caused by the other of the forward rotation and the reverse rotation of the motor to the first roller and not to transmit the rotation caused by the one of the forward rotation and the reverse rotation of the motor to the first roller, the second power transmitting mechanism comprising:

a sun gear that is rotated in a first rotational direction by receiving the rotation caused by the one of the forward rotation and the reverse rotation of the motor from the driven member and that is rotated in a second rotational direction by receiving the rotation caused by the other of the forward rotation and the reverse rotation of the motor from the driven member, the second rotational direction being reverse to the first rotational direction;

an arm pivotably supported by the sun gear;

a planetary gear rotatably supported by the arm in a state in which the planetary gear is engaged with the sun gear, the planetary gear being configured to be revolved around the sun gear; and a transmission gear engageable with the planetary gear and configured to transmit, to the first roller, rotation of the motor which is transmitted from the planetary gear, the planetary gear being configured to be revolved, in a direction in which the planetary gear is moved away from the transmission gear, by rotation of the sun gear in the first rotational direction, the planetary gear being configured to be revolved, in a direction in which the planetary gear is to be engaged with the transmission gear, by rotation of the sun gear in the second rotational direction, the first power transmitting mechanism comprising a transmission delayer that does not transmit the rotation of the motor from the driven member to the first roller until the motor is rotated by a particular amount from a time point at which the motor starts to be rotated in a rotational direction of the one of the forward rotation and the reverse rotation when rotation transmitted from the motor to the driven member is changed from the other of the forward rotation and the reverse rotation to the one of the forward rotation and the reverse rotation.

2. The conveyor according to claim 1, wherein the transmission delayer comprises a first rotary member and a second rotary member that is rotated coaxially with the first rotary member, wherein the first rotary member comprises a first surface and a second surface spaced apart from each other in a circumferential direction of the first rotary member, wherein the second rotary member comprises a contact portion located between the first surface and the second surface in the circumferential direction and contactable with the first surface and the second surface, and wherein a distance between a portion of the contact portion which is to contact the first surface and a portion of the contact portion which is to contact the second surface is less than a distance between the first surface and the second surface in the circumferential direction.

3. The conveyor according to claim 1, wherein the first power transmitting mechanism comprises a one-way clutch that is rotated together with the first roller by the rotation caused by the one of the forward rotation and the reverse rotation of the motor and that is idled with respect to the first roller by the rotation caused by the other of the forward rotation and the reverse rotation of the motor.

4. The conveyor according to claim 1, wherein the driven member is a second roller that is rotated, in a direction in which the sheet is to be conveyed in a conveying direction, by receiving from the motor the rotation caused by the one of the forward rotation and the reverse rotation of the motor and that is rotated, in a direction in which the sheet is to be conveyed in a direction reverse to the conveying direction, by receiving from the motor the rotation caused by the other of the forward rotation and the reverse rotation of the motor, wherein the first roller is configured to be rotated, in the direction in which the sheet is to be conveyed in the conveying direction, by receiving the rotation caused by the one of the forward rotation and the reverse rotation of the motor from the second roller via the first power transmitting mechanism, and the first roller is configured to be rotated, in the direction in which the sheet is to be conveyed in the direction reverse to the conveying direction, by receiving the rotation caused by the other of the forward rotation and the reverse rotation of the motor from the second roller via the second power transmitting mechanism, and wherein the second roller is provided on the first conveyance path at a position located upstream of the first roller in the conveying direction.

5. The conveyor according to claim 4, further comprising a switching mechanism that is switchable between (i) a first state in which transmission of the rotation of the motor from the second roller to the first roller via the second power transmitting mechanism is interrupted and (ii) a second state in which the transmission of the rotation of the motor from the second roller to the first roller via the second power transmitting mechanism is allowed.

6. The conveyor according to claim 5, further comprising:

a tray that supports the sheet;

a supply roller that supplies the sheet from the tray toward the second roller in the conveying direction; and a third power transmitting mechanism configured to transmit the rotation caused by the other of the forward rotation and the reverse rotation of the motor from the second roller to the supply roller and not to transmit the rotation caused by the one of the forward rotation and the reverse rotation of the motor from the second roller to the supply roller, wherein the switching mechanism is configured to allow transmission of the rotation of the motor from the second roller to the supply roller via the third power transmitting mechanism when the switching mechanism is in the first state, and wherein the switching mechanism is configured to interrupt the transmission of the rotation of the motor from the second roller to the supply roller via the third power transmitting mechanism when the switching mechanism is in the second state.

7. The conveyor according to claim 6, further comprising:

a third roller provided on a second conveyance path connected to the first conveyance path; and a fourth power transmitting mechanism configured to transmit the forward rotation and the reverse rotation of the motor from the second roller to the third roller as rotation in a direction in which the sheet to be guided into the second conveyance path is allowed to be conveyed, wherein the switching mechanism is configured to interrupt transmission of the rotation of the motor from the second roller to the third roller via the fourth power transmitting mechanism when the switching mechanism is in the first state, and wherein the switching mechanism is configured to allow the transmission of the rotation of the motor from the second roller to the third roller via the fourth power transmitting mechanism when the switching mechanism is in the second state.

8. The conveyor according to claim 7, further comprising a fourth roller provided on the first conveyance path at a position located downstream of the first roller in the conveying direction, wherein the second conveyance path is connected to the first conveyance path at (i) a first connecting position located between the first roller and the fourth roller and (ii) a second connecting position located upstream of the second roller in the conveying direction, wherein the first power transmitting mechanism is configured to transmit the rotation caused by the one of the forward rotation and the reverse rotation of the motor from the second roller to the fourth roller via the first roller, and wherein the second power transmitting mechanism is configured to transmit the rotation caused by the other of the forward rotation and the reverse rotation of the motor from the second roller to the fourth roller via the first roller.

9. The conveyor according to claim 8, wherein the first power transmitting mechanism comprises:

a first pulley that is rotated in conjunction with rotation of the second roller;

a second pulley that is rotated to rotate the first roller in conjunction with rotation of the second pulley;

a third pulley that is rotated in conjunction with rotation of the second pulley;

a fourth pulley that is rotated to rotate the fourth roller in conjunction with rotation of the fourth pulley;

a first belt looped over the first pulley and the second pulley; and a second belt looped over the third pulley and the fourth pulley, and wherein the second power transmitting mechanism comprises the third pulley, the fourth pulley, and the second belt.

10. The conveyor according to claim 4, wherein the second power transmitting mechanism comprises a speed reducer configured to reduce a speed of rotation of the first roller rotated by receiving the rotation caused by the other of the forward rotation and the reverse rotation of the motor via the second power transmitting mechanism, such that the speed of rotation of the first roller is less than a speed of rotation of the second roller.

11. The conveyor according to claim 1, wherein the first power transmitting mechanism is configured to transmit the rotation of the motor to the first roller from one of opposite sides of the first roller in an axial direction thereof, and wherein the second power transmitting mechanism is configured to transmit the rotation of the motor to the first roller from the other of the opposite sides of the first roller in the axial direction thereof.

12. An image recording apparatus, comprising:

a conveyor comprising (i) a motor that is rotated forwardly and reversely, (ii) a driven member that is driven by rotation caused by at least one of forward rotation and reverse rotation of the motor, the caused rotation being transmitted from the motor, (iii) a first roller provided on a first conveyance path through which a sheet is to be conveyed, (iv) a first power transmitting mechanism configured to transmit rotation caused by one of the forward rotation and the reverse rotation of the motor to the first roller and not to transmit rotation caused by the other of the forward rotation and the reverse rotation of the motor from the driven member to the first roller, and (v) a second power transmitting mechanism configured to transmit the rotation caused by the other of the forward rotation and the reverse rotation of the motor to the first roller and not to transmit the rotation caused by the one of the forward rotation and the reverse rotation of the motor to the first roller; and an image recorder provided on the first conveyance path and configured to record an image on the sheet, the second power transmitting mechanism comprising:

a sun gear that is rotated in a first rotational direction by receiving the rotation caused by the one of the forward rotation and the reverse rotation of the motor from the driven member and that is rotated in a second rotational direction by receiving the rotation caused by the other of the forward rotation and the reverse rotation of the motor from the driven member, the second rotational direction being reverse to the first rotational direction;

an arm pivotably supported by the sun gear;

a planetary gear rotatably supported by the arm in a state in which the planetary gear is engaged with the sun gear, the planetary gear being configured to be revolved around the sun gear; and a transmission gear engageable with the planetary gear and configured to transmit, to the first roller, rotation of the motor which is transmitted from the planetary gear, the planetary gear being configured to be revolved, in a direction in which the planetary gear is moved away from the transmission gear, by rotation of the sun gear in the first rotational direction, the planetary gear being configured to be revolved, in a direction in which the planetary gear is to be engaged with the transmission gear, by rotation of the sun gear in the second rotational direction, the first power transmitting mechanism comprising a transmission delayer that does not transmit the rotation of the motor from the driven member to the first roller until the motor is rotated by a particular amount from a time point at which the motor starts to be rotated in a rotational direction of the one of the forward rotation and the reverse rotation when rotation transmitted from the motor to the driven member is changed from the other of the forward rotation and the reverse rotation to the one of the forward rotation and the reverse rotation.

13. The image recording apparatus according to claim 12, wherein the image recorder is provided upstream of the first roller in the conveying direction.

* * * * *